US009607511B2

(12) United States Patent
Wakayama et al.

(10) Patent No.: US 9,607,511 B2
(45) Date of Patent: Mar. 28, 2017

(54) VEHICLE GUIDANCE SYSTEM, VEHICLE GUIDANCE METHOD, MANAGEMENT DEVICE, AND CONTROL METHOD FOR SAME

(71) Applicant: NEC Corporation, Minato-ku, Tokyo (JP)

(72) Inventors: Hisaya Wakayama, Tokyo (JP); Naoki Shiota, Tokyo (JP); Junpei Kamimura, Tokyo (JP); Norihisa Iga, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/027,569

(22) PCT Filed: May 20, 2014

(86) PCT No.: PCT/JP2014/063338
§ 371 (c)(1),
(2) Date: Apr. 6, 2016

(87) PCT Pub. No.: WO2015/052953
PCT Pub. Date: Apr. 16, 2015

(65) Prior Publication Data

US 2016/0232787 A1 Aug. 11, 2016

(30) Foreign Application Priority Data

Oct. 8, 2013 (JP) ..... 2013-210848

(51) Int. Cl.
*G08G 1/01* (2006.01)
*G08G 1/052* (2006.01)
(Continued)

(52) U.S. Cl.
CPC ..... *G08G 1/0145* (2013.01); *G08G 1/0116* (2013.01); *G08G 1/0133* (2013.01);
(Continued)

(58) Field of Classification Search
CPC .. G08G 1/0145; G08G 1/0116; G08G 1/0133; G08G 1/052; G08G 1/065; G08G 1/095
(Continued)

(56) References Cited

U.S. PATENT DOCUMENTS

2013/0103296 A1* 4/2013 Koshizen ..... B60K 37/02 701/119
2013/0116909 A1* 5/2013 Shida ..... B60W 30/16 701/96
(Continued)

FOREIGN PATENT DOCUMENTS

JP 2005-182219 A 7/2005
JP 3822424 B 6/2006
JP 2012-073981 A 4/2012

OTHER PUBLICATIONS

International Search Report for PCT Application No. PCT/JP2014/063338, mailed on Aug. 19, 2014.
(Continued)

*Primary Examiner* — McDieunel Marc
*Assistant Examiner* — James E Stroud

(57) ABSTRACT

This vehicle guidance system carries out guidance of vehicles that are traveling on roads making up a road network, the vehicle guidance system being provided with: a flow detection unit that detects the flow of vehicles on each of the roads making up a road network, and generates flow information indicating the detection result; a storage unit that creates associations between the flow information for the roads which has been generated by the flow detection unit, and road-identifying information indicating the corresponding roads, and storing the information; a decision unit that, for each of the roads making up the road network, specifies a candidate road that is a road which vehicles flow from the road in question, acquires the flow information that is stored in association with the road-identifying information
(Continued)

indicating the specified candidate road in question, and based on the acquired flow information, decides on a flow increase or decrease policy of vehicles on the candidate road; and a guidance unit that carries out guidance of the vehicles, in accordance with the decision by the decision unit.

10 Claims, 21 Drawing Sheets

(51) Int. Cl.
*G08G 1/065* (2006.01)
*G08G 1/095* (2006.01)

(52) U.S. Cl.
CPC ..... *G08G 1/052* (2013.01); *G08G 1/065* (2013.01); *G08G 1/095* (2013.01)

(58) Field of Classification Search
USPC ..... 701/119
See application file for complete search history.

(56) References Cited

U.S. PATENT DOCUMENTS

2013/0214940 A1* 8/2013 Sako ..... G01C 21/34 340/905
2014/0195138 A1* 7/2014 Stelzig ..... G08G 1/0116 701/119
2014/0200797 A1* 7/2014 Ye ..... G08G 1/0112 701/119
2014/0354453 A1* 12/2014 Fourie ..... G08G 1/144 340/932.2
2015/0199905 A1* 7/2015 Hayee ..... G08G 1/22 701/118
2015/0339570 A1* 11/2015 Scheffler ..... G06N 3/10 706/16
2016/0210852 A1* 7/2016 Buchholz ..... G08G 1/0112

OTHER PUBLICATIONS

English translation of Written opinion for PCT Application No. PCT/JP2014/063338.

* cited by examiner

VEHICLE GUIDANCE SYSTEM, VEHICLE GUIDANCE METHOD, MANAGEMENT DEVICE, AND CONTROL METHOD FOR SAME

This application is a National Stage Entry of PCT/JP2014/063338 filed on May 20, 2014, which claims priority from Japanese Patent Application 2013-210848 filed on, Oct. 8, 2013 the contents of all of which are incorporated herein by reference, in their entirety.

TECHNICAL FIELD

The present invention relates to a vehicle guidance system, a vehicle guidance method, a management device, and a control method for guiding vehicles traveling on roads.

BACKGROUND ART

In recent years, in a road transportation system, traffic congestion is a serious problem. The economical loss arising from traffic congestion is said to be from several trillion yen to several ten trillion yen in the world as a whole.

As fundamental measures for eliminating traffic congestion, there are proposed a method in which roads of a sufficient capacity are built, and a method in which transportation are shifted to alternative transportation such as trains or airplanes. These measures, however, require a huge amount of time to see results. Further, in urban areas where traffic congestion problems are serious, it is difficult to secure land for building roads. Thus, it is difficult to implement the method in which roads of a sufficient capacity are built. Further, when the method in which transportation are shifted to alternative transportation employed, it may be difficult to obtain sufficient results, taking into consideration the climates, cultures, public security, and the like.

In view of the above, various measures for alleviating traffic congestion have been proposed by efficiently utilizing the existing roads with use of Intelligent Transport Systems (ITS). Using the ITS makes it possible to expediently obtain the results, although the results are limited, as compared with the fundament measures for eliminating traffic congestion as described above.

As a measure for alleviating traffic congestion with use of the ITS, there is a method in which vehicles are notified of traffic congestion information with use of Vehicle Information and Communication System (VICS) (registered trademark).

As another measure, there is a method in which vehicles are guided to a bypass road for bypassing a congested road where the traffic is congested when traffic congestion has occurred. According to this method, however, when vehicles bound for the congested road are simultaneously guided to the bypass road, the vehicles are concentrated on the bypass road, and traffic congestion may also occur on the bypass road.

In view of the above, in PTL 1 (JP3822424B), vehicles are guided in a time-sharing manner between a congested road and a bypass road. This makes it possible to decentralize the vehicles between the congested road and the bypass road.

CITATION LIST

Patent Literature

[PTL 1] Japanese Patent Publication No. 3822424

SUMMARY OF INVENTION

Technical Problem

The technique disclosed in PTL 1 is such that when traffic congestion has occurred, vehicles are decentralized between a congested road where the traffic is congested and a bypass road for alleviating traffic congestion on the congested road, while suppressing occurrence of traffic congestion on the bypass road.

Normally, in a road area where the traffic is congested, the speeds of vehicles are lowered, and the flow rate of vehicles on the congested road is remarkably lowered. Therefore, when guiding of vehicles is started after occurrence of traffic congestion, it takes a long time until the traffic congestion is eliminated on the congested road. Thus, in the technique disclosed in PTL 1, it may be impossible to sufficiently alleviate traffic congestion.

Further, in the technique disclosed in PTL 1, suppressing occurrence of traffic congestion itself is not sufficiently considered.

Normally, assuming that the total number of vehicles traveling on each of the roads included in a road network is constant, it is necessary to use up the road capacity of each road as much as possible in order to suppress occurrence of traffic congestion as much as possible. In other words, it is necessary to perform a control such that the total number of flow rates of vehicles on each road is made as large as possible depending on the traveling status of vehicles on each of the roads included in a road network. In the technique disclosed in PTL 1, the aforementioned control is not taken into account, and it may be impossible to sufficiently suppress occurrence of traffic congestion itself.

An object of the present invention is to provide a vehicle guidance system, a vehicle guidance method, a management device, and a control method that enable to suppress occurrence of traffic congestion.

Solution to Problem

In order to achieve the above object, a vehicle guidance system according to an exemplary aspect of the present invention guides vehicles traveling on roads included in a road network. The vehicle guidance system includes:

a flow rate detection unit that detects a flow rate of vehicles on each of the roads included in the road network, and generating flow rate information representing a detection result;

a storage unit that stores the flow rate information of each of the roads generated by the flow rate detection unit in association with road identification information that identifies a road corresponding to the flow rate information;

a determination unit specifies, as a candidate road, a road which vehicles enter from each of the roads included in the road network, acquires the flow rate information stored in the storage unit in association with the road identification information of the candidate road specified, and determines a rule regarding changing of the flow rate of vehicles on the candidate road based on the flow rate information acquired; and a guidance unit guides vehicles according to a determination result by the determination unit.

In order to achieve the above object, a vehicle guidance method according to an exemplary aspect of the present invention is a method for guiding vehicles traveling on roads included in a road network in a vehicle guidance system. The vehicle guidance method includes:

detecting a flow rate of vehicles on each of the roads included in the road network, and generating flow rate information representing a detection result;

storing the flow rate information of each of the roads in association with road identification information that identifies a road corresponding to the flow rate information;

specifying, as a candidate road, a road which vehicles enter from each of the roads included in the road network, acquiring the flow rate information stored in association with the road identification information of the candidate road specified, and determining a rule regarding changing of the flow rate of vehicles on the candidate road based on the flow rate information acquired; and guiding vehicles according to a determination result.

In order to achieve the above object, a management device according to an exemplary aspect of the present invention includes:

an acquisition unit that acquires flow rate information representing a detection result on a flow rate of vehicles on each of roads included in a road network;

a storage unit stores the flow rate information of each of the roads acquired by the acquisition unit in association with road identification information that identifies a road corresponding to the flow rate information; and a determination unit that specifies, as a candidate road, a road which vehicles enter from each of the roads included in the road network, acquires the flow rate information stored in the storage unit in association with the road identification information of the candidate road specified, determining a rule regarding changing of the flow rate of vehicles on the candidate road based on the flow rate information acquired and causing guidance unit to guide vehicles to guide the vehicles according to the determination result.

In order to achieve the above object, a controlling method according to an exemplary aspect of the present invention is a method for controlling a management device which manages guiding of vehicles traveling on each of roads included in a road network. The method includes:

acquiring flow rate information representing a detection result on a flow rate of vehicles on each of the roads included in the road network;

storing the flow rate information of each road in association with road identification information that identifies a road corresponding to the flow rate information; and specifying, as a candidate road, a road which vehicles enter from each of the roads included in the road network, acquiring the stored flow rate information in association with the road identification information of the candidate road specified, determining a rule regarding changing of a flow rate of vehicles on the candidate road based on the flow rate information acquired and causing guidance unit to guide vehicles to guide the vehicles according to the determination result.

Advantageous Effects of Invention

According to the present invention, it is possible to suppress occurrence of traffic congestion.

DESCRIPTION OF EMBODIMENTS

Figure 1:
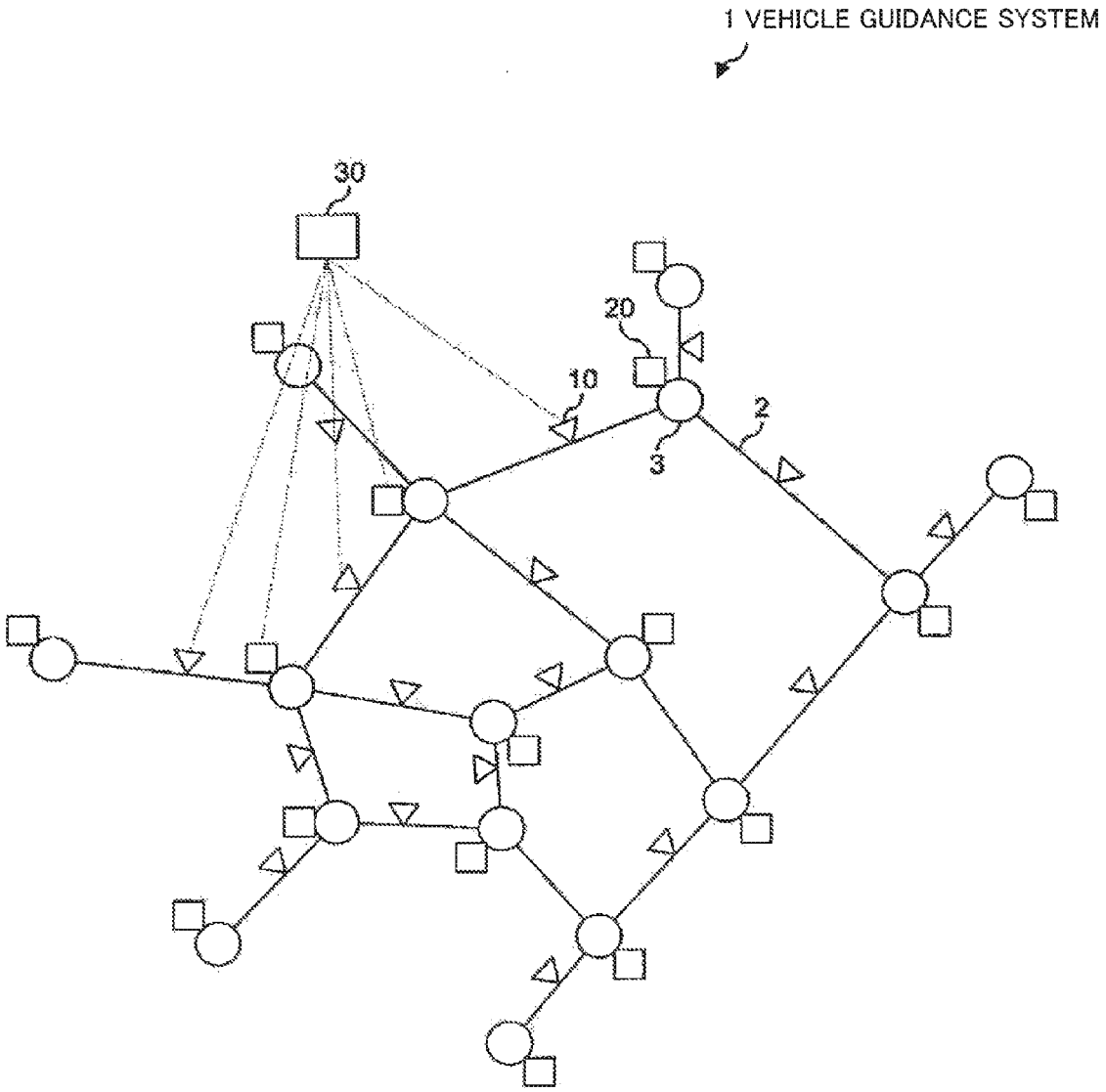
FIG. 1 is a diagram illustrating an overall configuration of a vehicle guidance system in a first exemplary embodiment of the present invention.

In the following, exemplary embodiments of the present invention are described referring to the drawings.

<First Exemplary Embodiment>

FIG. 1 is a diagram illustrating an overall configuration of a vehicle guidance system 1 in the first exemplary embodiment of the present invention. In the following, description will be given using an example in which the vehicle guidance system 1 is applied to a road network included in a plurality of roads 2, and a plurality of intersections 3 at which the roads 2 are connected to each other.

The vehicle guidance system 1 in the exemplary embodiment includes a flow rate detection device 10 installed at each of the roads 2 included in a road network, a vehicle guidance device 20 installed at each of the intersections 3, and a server 30 which communicates with the flow rate detection devices 10 and with the vehicle guidance devices 20. The server 30 is an example of a management device.

The flow rate detection device 10 detects a flow rate of vehicles and speeds of vehicles on the road 2 where the flow rate detection device 10 is installed. Further, the flow rate detection device 10 transmits, to the server 30, flow rate information indicative of the detected flow rate of vehicles and the detected speeds of vehicles, and road identification information indicative of the road 2 where the flow rate detection device 10 is installed, and the traveling direction of vehicles on the road 2.

The vehicle guidance device 20 guides vehicles in the vicinity of the intersection 3 where the vehicle guidance device 20 is installed.

The server 30 determines whether the flow rate of vehicles on each road 2 is to be increased or decreased based on flow rate information acquired from the flow rate detection device 10, and causes the vehicle guidance device 20 to guide the vehicles according to the determination result.

Figure 2:
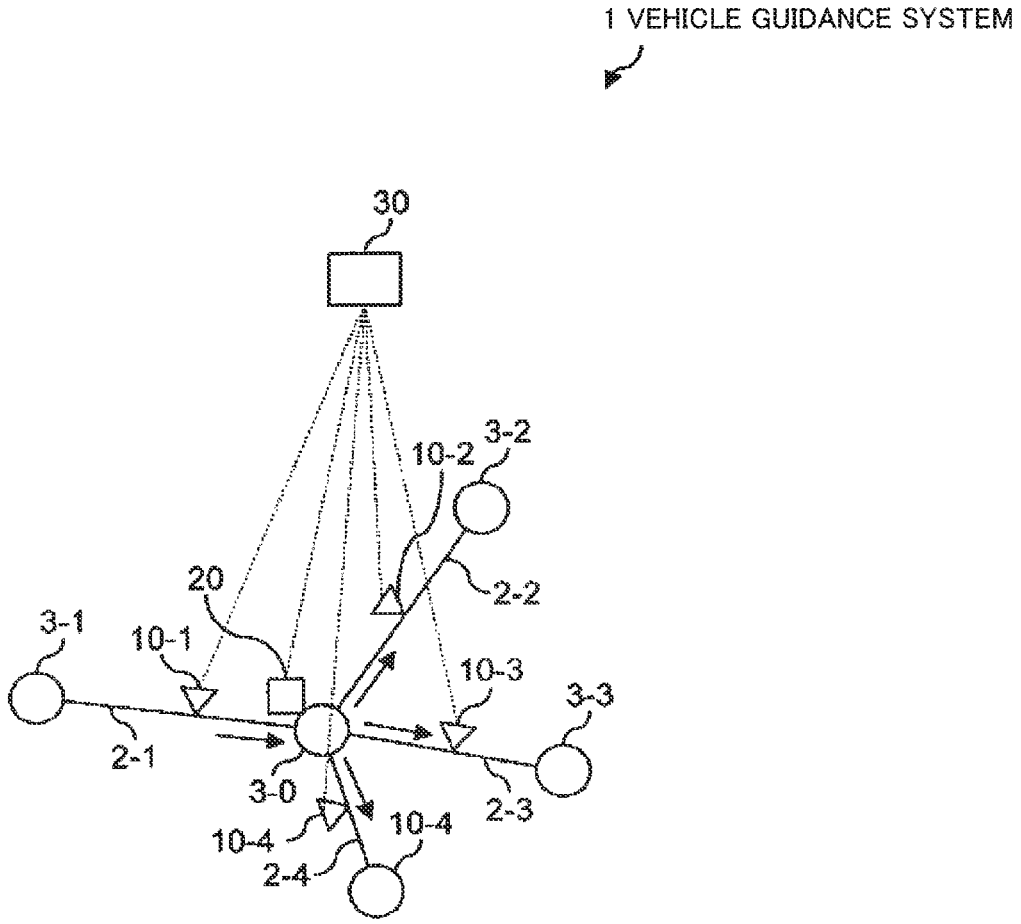
FIG. 2 is a diagram illustrating a part of a configuration of the vehicle guidance system illustrated in FIG. 1.

FIG. 2 is a diagram illustrating a part of a configuration of the vehicle guidance system 1 illustrated in FIG. 1.

Referring to FIG. 2, the intersection 3-0 is connected to the intersection 3-1 via the road 2-1, is connected to the intersection 3-2 via the road 2-2, is connected to the intersection 3-3 via the road 2-3, and is connected to the intersection 3-4 via the road 2-4. Vehicles which enter the intersection 3-0 from the road 2-1 go to one of the roads 2-2, 2-3, and 2-4.

The roads 2-1, 2-2, 2-3, and 2-4 are respectively installed with the flow rate detection devices 10-1, 10-2, 10-3, and 10-4. The flow rate detection devices 10-1, 10-2, 10-3, and 10-4 respectively detect the flow rate of vehicles and the speeds of vehicles on the roads 2 where the flow rate detection devices 10-1, 10-2, 10-3, and 10-4 are installed, and transmit, to the server 30, flow rate information indicative of the detection result, and road identification information.

The server 30 selects one of the roads 2 included in a road network, and specifies a road (hereinafter, called as a candidate road) to which vehicles enter from the selected road (hereinafter, referred to as a selected road). Further, the server 30 determines whether the flow rate of vehicles on the candidate road is to be increased or decreased based on the flow rate information acquired from the flow rate detection device 10 installed on the candidate road, and causes the vehicle guidance device 20 to guide the vehicles according to the determination result.

Referring to FIG. 2, for example, when the server 30 selects the road 2-1 as a selected road, the server 30 specifies the roads 2-2, 2-3, and 2-4 to which vehicles enter from the road 2-1, as candidate roads. Further, the server 30 determines whether the flow rate of vehicles on each candidate road is to be increased or decreased based on the flow rate information acquired from the flow rate detection devices 10-2, 10-3, and 10-4 installed on the respective candidate roads. Further, the server 30 outputs, to the vehicle guidance device 20 installed at the intersection 3-0 where the roads 2-1, 2-2, 2-3, and 2-4 are connected to each other, control information indicative of determination whether the flow rate of vehicles on each candidate road is to be increased or decreased.

The vehicle guidance device 20 guides the vehicles traveling on the road 2-1 according to control information output from the server 30.

Next, a configuration of the flow rate detection device 10, a configuration of the vehicle guidance device 20, and a configuration of the server 30 are described.

Figure 3:
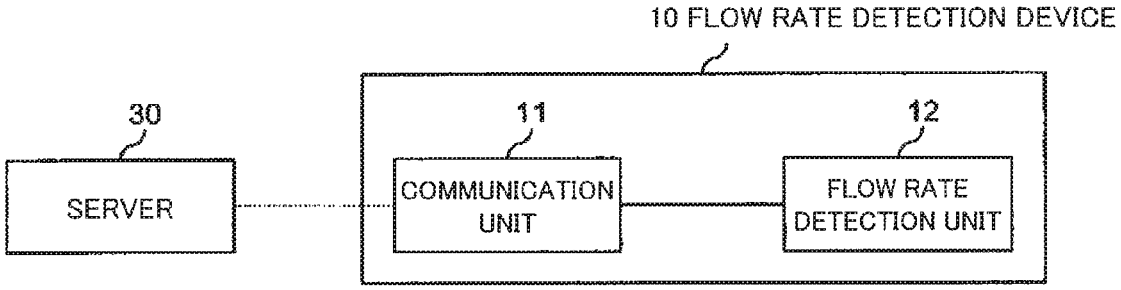
FIG. 3 is a block diagram illustrating a configuration of a flow rate detection device illustrated in FIG. 1.

First of all, the configuration of the flow rate detection device 10 is described referring to the block diagram illustrated in FIG. 3.

The flow rate detection device 10 illustrated in FIG. 3 includes a communication unit 11 and a flow rate detection unit 12.

The communication unit 11 communicates with the server 30 by radio or by wire. Specifically, the communication unit 11 communicates with the server 30 via a wireless communication network such as GSM (Global System for Mobile Communication) (registered trademark), 3G (3rd Generation) or LTE (Long Term Evolution). Further, the communication unit 11 communicates with the server 30 with use of a wireless LAN (Local Area Network), Bluetooth (registered trademark), Zigbee (registered trademark), or the like. Further, the communication unit 11 communicates with the server 30 via a wired network such as FTTH (Fiber to the Home), xDSL (Digital Subscriber Line), or ONU (Optical Network Unit).

The flow rate detection unit 12 periodically detects the flow rate of vehicles and the speeds of vehicles on the road 2 where the flow rate detection device 10 is installed, and generates flow rate information indicative of the detection result. Further, the flow rate detection unit 12 causes the communication unit 11 to transmit the generated flow rate information and road identification information to the server 30. The flow rate detection unit 12 is an example of a flow rate detection unit.

Alternatively, the flow rate detection device 10 may include a plurality of flow rate detection units 12. The flow rate detection units 12 may detect the flow rate of vehicles and the speeds of vehicles at a plurality of points on the road 2 where the flow rate detection device 10 is installed. Further alternatively, the flow rate detection device 10 may be installed at a plurality of points on a road, and each of the flow rate detection devices 10 may detect the flow rate of vehicles and the speeds of vehicles at each point where a corresponding one of the flow rate detection devices 10 is installed.

Detecting the flow rate of vehicles and the speeds of vehicles at a plurality of points on one road 2 makes it possible to detect a variation in flow rate of vehicles and a timewise change in flow rate of vehicles on the road 2. Generally, regarding a road 2 connecting two intersections 3, it is conceived that vehicles near the entrance intersection (one of the intersections 3) to which the vehicles enter stay longer on the road 2 than vehicles near the exit intersection (the other of the intersections 3) from which the vehicles exit. In view of the above, applying a weighting factor to a detection result at a point near the entrance intersection rather than a detection result at a point near the exit intersection makes it possible to obtain a detection result approximate to an actual state.

Figure 4:
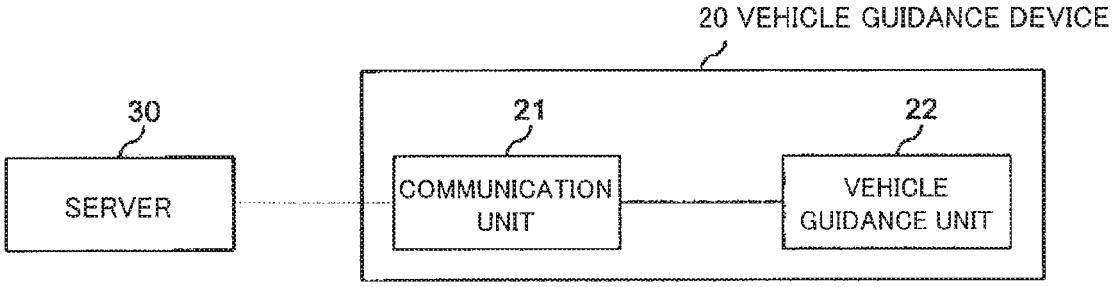
FIG. 4 is a block diagram illustrating a configuration of a vehicle guidance device illustrated in FIG. 1.

Next, the configuration of the vehicle guidance device 20 is described referring to the block diagram illustrated in FIG. 4.

The vehicle guidance device 20 illustrated in FIG. 4 includes a communication unit 21 and a vehicle guidance unit 22.

The communication unit 21 communicates with the server 30 by radio or by wire.

When the communication unit 21 receives control information from the server 30, the vehicle guidance unit 22 guides vehicles according to determination whether the flow rate of vehicles on each road 2 is to be increased or decreased indicated by the control information. Specifically, the vehicle guidance unit 22 guides a larger number of vehicles to a candidate road on which it is determined to increase the flow rate of vehicles. The vehicle guidance unit 22 is an example of a guidance unit.

A concrete example of the vehicle guidance unit 22 is a display device such as a video billboard installed at the intersection 3. In this case, the vehicle guidance unit 22 displays an image or the like indicative of a direction in which vehicles are guided according to control information.

Figure 5:
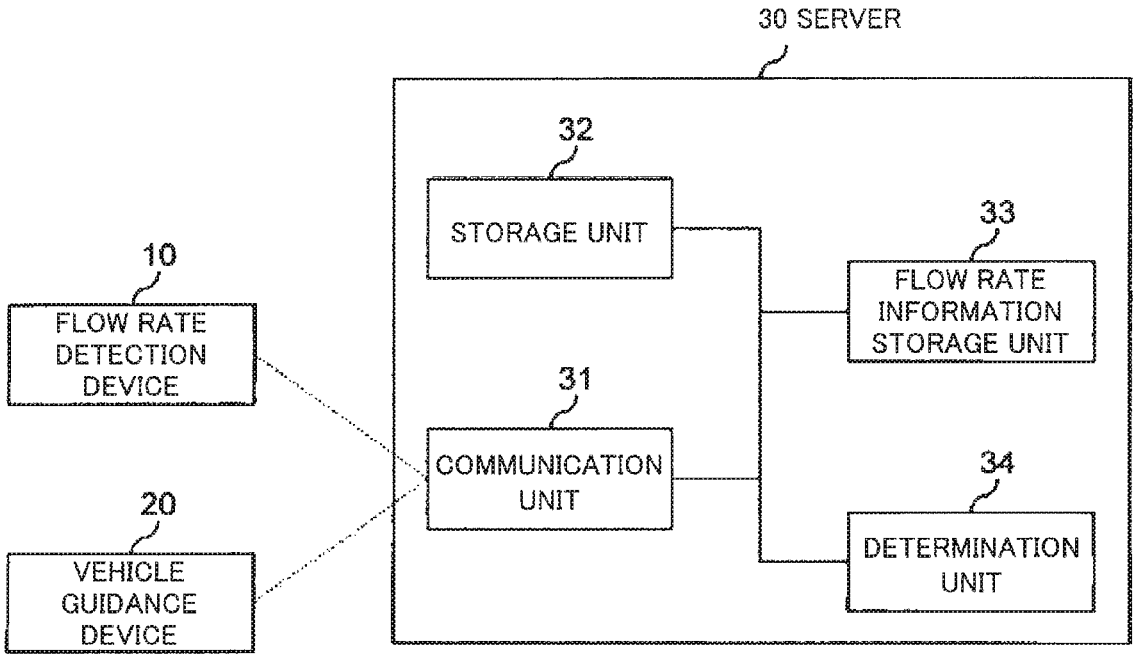
FIG. 5 is a block diagram illustrating a configuration of a server illustrated in FIG. 1.

Next, the configuration of the server 30 is described referring to the block diagram illustrated in FIG. 5.

The server 30 illustrated in FIG. 5 includes a communication unit 31, a storage unit 32, a flow rate information storage unit 33, and a determination unit 34.

The communication unit 31 communicates with the flow rate detection device 10 (communication unit 11) and with the vehicle guidance device 20 (communication unit 21). The communication unit 31 is an example of an acquisition unit.

The storage unit 32 temporarily or permanently stores various items of information. Concrete examples of the storage unit 32 are an HDD (Hard Disk Drive) a flash memory such as an SSD (Solid State Drive), a DRAM (Dynamic Random Access Memory), an optical disc, a magnetic tape, or the like. The storage unit 32 is an example of a storage unit.

When the communication unit 31 receives flow rate information and road identification information from the flow rate detection device 10, the flow rate information storage unit 33 causes the storage unit 32 to store the flow rate information and the road identification information in association with each other.

The determination unit 34 selects one of the roads 2 included in a road network as a selected road, and specifies a road which vehicles enter from the selected road as a candidate road. Further, the determination unit 34 acquires flow rate information stored in the storage unit 32 in association with road identification information indicative of a candidate road, and determines a rule regarding changing of the flow rate of vehicles on the candidate road based on the acquired flow rate information. Further, the determination unit 34 causes the communication unit 32 to transmit control information indicative of the rule including a determination whether the flow rate of vehicles on the candidate road is to be increased or decreased to the vehicle guidance device 20 installed at the intersection 3 where the selected road and the candidate road are connected to each other. The determination unit 34 is an example of a determination unit.

Next, an operation of the vehicle guidance system 1 in the exemplary embodiment is described.

Figure 6:
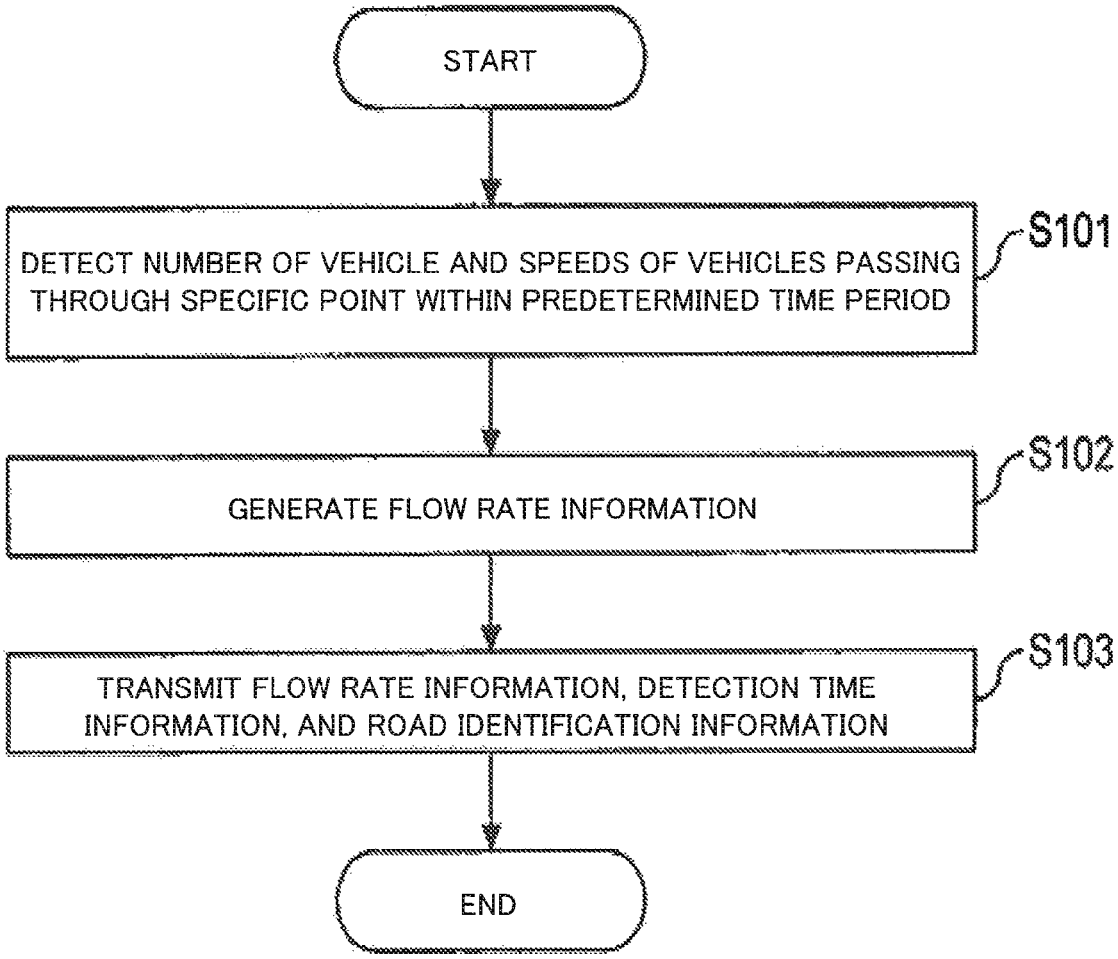
FIG. 6 is a flowchart illustrating an operation of a flow rate detection unit illustrated FIG. 3.

First of all, an operation of the flow rate detection unit 12 is described referring to the flowchart illustrated in FIG. 6.

As a first step, the flow rate detection unit 12 detects the number of vehicles and the speeds of vehicles passing through a specific point on the road 2 where the flow rate detection device 10 is installed within a predetermined time period (Step S101).

Subsequently, the flow rate detection unit 12 calculates a flow rate of vehicles based on Eq. (1) expressed below.

$$Q=m/t \tag{1}$$

In Eq. (1), "Q" denotes a flow rate of vehicles, "m" denotes the number of vehicles passing through a specific point within a detection time period, and "t" denotes the detection time period.

The flow rate detection unit 12 generates flow rate information indicative of the calculated vehicle flow rate Q and the detected vehicle speeds (Step S102).

Subsequently, the flow rate detection unit 12 causes the communication unit 11 to transmit, to the server 30, the generated flow rate information, detection time information indicative of a time at which detection is performed, and road identification information (Step S103).

The flow rate detection unit 12 periodically performs Step S101 to S103 as described above. This makes it possible to periodically update the flow rate information of each road 2. Thus, it is possible to determine whether the flow rate of vehicles on each road 2 is to be increased or decreased based on latest flow rate information.

Figure 7:
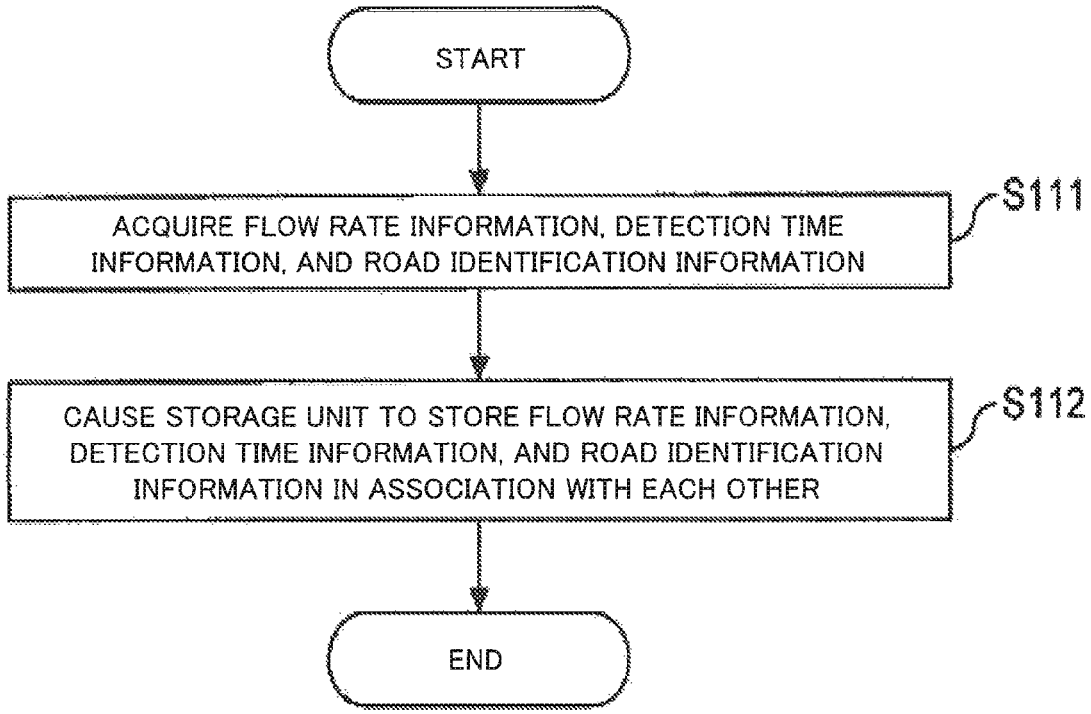
FIG. 7 is a flowchart illustrating an operation of a flow rate information storage unit illustrated in FIG. 4.

Next, an operation of the flow rate information storage unit 33 is described referring to the flowchart illustrated in FIG. 7.

The flow rate information storage unit 33 performs the following process in response to receiving flow rate information from the flow rate detection device 10 by the communication unit 31.

As a first step, the flow rate information storage unit 33 acquires flow rate information, detection time information, and road identification information received by the communication unit 31 (Step S111).

Subsequently, the flow rate information storage unit 33 causes the storage unit 32 to store the acquired flow rate information, detection time information, and road identification information in association with each other (Step S112), and the process is terminated.

Figure 8:
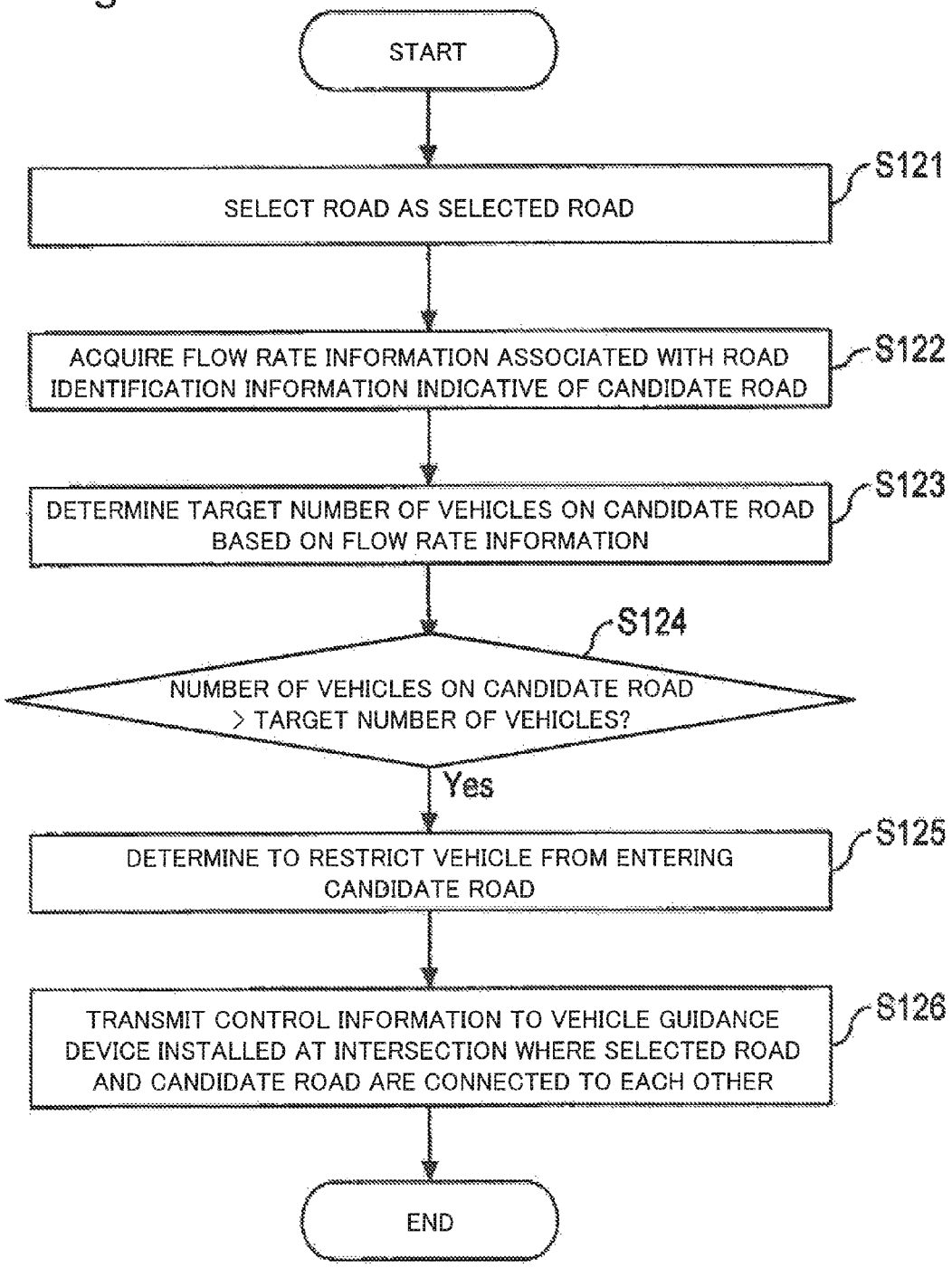
FIG. 8 is a flowchart illustrating an operation of a determination unit illustrated in FIG. 4.

Next, an operation of the determination unit 34 is described referring to the flowchart illustrated in FIG. 8.

As a first step, the determination unit 34 selects one of the roads 2 included in a road network as a selected road (Step S121). The selected road selection method includes a method in which all the roads 2 are successively selected, a method in which roads are selected at random from all the roads 2, a method in which a road connected to the intersection 3 where the vehicle guidance device 20 is installed is selected, or the like.

Subsequently, the determination unit 34 specifies a road which vehicles enter from the selected road as a candidate road, and acquires flow rate information stored in the storage unit 32 in association with road identification information indicative of the candidate road (Step S122). Note that the determination unit 34 acquires flow rate information at a latest detection time.

In the example illustrated in FIG. 2, for example, when the road 2-1 is selected as a selected road, the determination unit 34 specifies the roads 2-2, 2-3, and 2-4 to which vehicles enter from the road 2-1 as candidate roads, and acquires flow rate information of the roads 2-2, 2-3, and 2-4.

Subsequently, the determination unit 34 determines the target number of vehicles on each candidate road based on the flow rate information for each candidate road (Step S123). The target number of vehicles determination method will be described later.

Subsequently, the determination unit 34 determines whether the number of vehicles on the candidate road is larger than the target number of vehicles for each candidate road (Step S124). The number of vehicles on a candidate road is the number of vehicles m in the above-described Eq. (1).

When it is determined that the number of vehicles on the candidate road is larger than the target number of vehicles (Yes in Step S124), the determination unit 34 restricts vehicles from entering the candidate road. Specifically, the determination unit 34 determines to decrease the flow rate of vehicles on the candidate road (Step S125).

Although not illustrated, when the number of vehicles on the candidate road is equal to or smaller than the target number of vehicles (No in Step S124), the determination unit 34 determines that the entering of the vehicles to the candidate road is to be limited, that is, the flow rate of vehicles on the candidate road is to be increased or maintained, for example.

When the determination unit 34 determines whether the flow rate of vehicles is to be increased or decreased for all the candidate roads, the determination unit 34 causes the communication unit 31 to transmit control information indicative of the determination result to the vehicle guidance device 20 installed at the intersection 3 where the selected road and the candidate roads are connected to each other (Step S126).

The determination unit 34 periodically performs Step S121 to S126 as described above.

Next, an example of the target number of vehicles determination method is described.

Generally, the road capacity is constant all the time. Therefore, when the number of vehicles on the road 2 increases and reaches a predetermined value or more, the distance between vehicles decreases, and the average speed of each vehicle is lowered. Specifically, there is a negative correlation between the number of vehicles on the road 2 and a vehicle average speed. Further, the vehicle flow rate Q on the road 2 is expressed by the following Eq. (2).

$$Q=Mv/I \tag{2}$$

In Eq. (2), "M" denotes the number of vehicles on the road 2, "I" denotes a road capacity, and "v" denotes a vehicle average speed.

Figure 9:
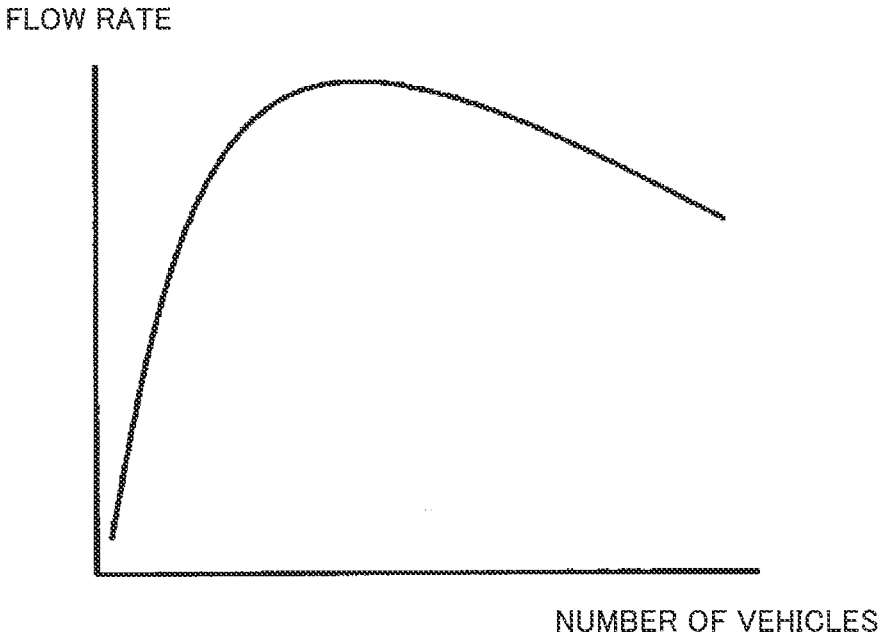
FIG. 9 is a diagram illustrating a relationship between the number of vehicles and a flow rate.

Normally, taking into account that there is an upper limit for the vehicle average speed v, when the number M of vehicles is small, the flow rate Q increases linearly accompanied by an increase in the number of vehicles. On the other hand, as described above, when the number M of vehicles reaches a predetermined value or more, a variation of the flow rate Q decreases, because there is a negative correlation between the number M of vehicles and the vehicle average speed v. Therefore, it is possible to approximate the flow rate Q as an upwardly convex function as illustrated in FIG. 9.

Further, the total number of vehicles on each of the roads 2 included in a road network is a constant value, no matter how many number of vehicles are allocated to each road 2.

In view of the above, assuming that the total number of vehicles is constant, it is possible to obtain the number of vehicles (target number of vehicles) to be allocated to each road 2, which makes it possible to maximize the flow rate of vehicles on each road 2, by solving a so-called convex programming problem.

Figure 10A:
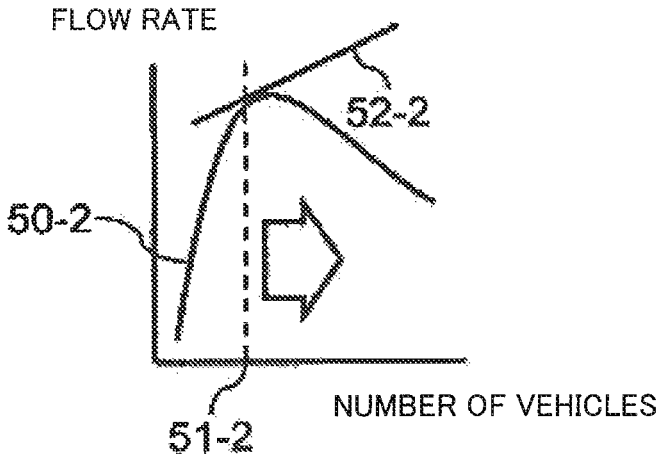
FIG. 10A is a diagram for describing how to determine the target number of vehicles.
Figure 10B:
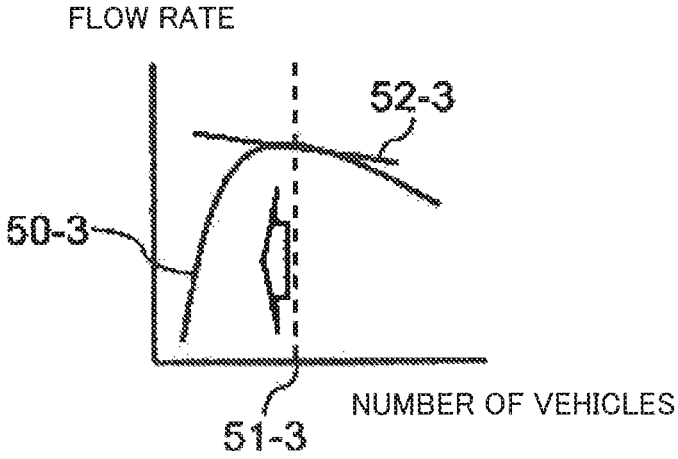
FIG. 10B is a diagram for describing how to determine the target number of vehicles.
Figure 10C:
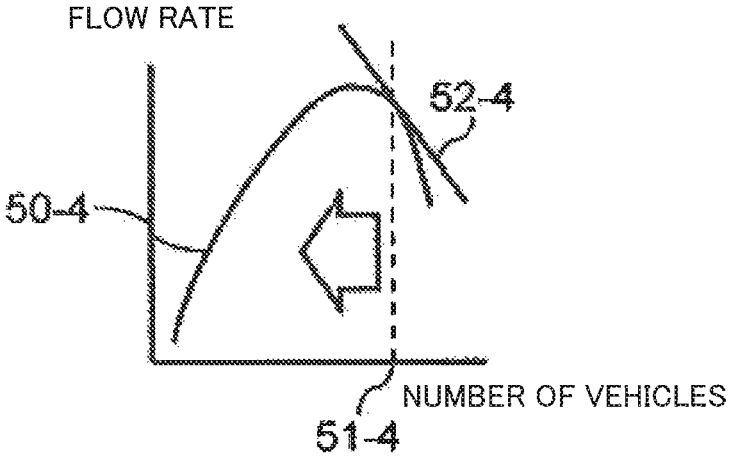
FIG. 10C is a diagram for describing how to determine the target number of vehicles.

FIG. 10A to FIG. 10C are diagrams for describing how to determine the target number of vehicles with use of the convex programming problem. In the following, description is given for an exemplary case in which the target number of vehicles on each road is determined based on an assumption that the candidate roads are the roads 2-2, 2-3, and 2-4 illustrated in FIG. 2.

It is possible to obtain the number of vehicles on the road 2 at a time when a flow rate is detected, based on flow rate information of the road 2. Further, it is possible to obtain a convex function representing a relationship between the number of vehicles and the flow rate of vehicles on the road 2 based on the flow rate information of the road 2. FIG. 10A to FIG. 10C respectively illustrate convex functions 50-1 to 50-4 each representing a relationship between the number of vehicles and the flow rate of vehicles to be obtained from the respective items of flow rate information of the roads 2-2 to 2-4 illustrated in FIG. 2.

It is known that satisfying the following Eq. (3) is a necessary and sufficient condition in order to obtain an optimum solution in a convex programming problem.

$$\left.\frac{\partial Qi}{\partial m}\right|_{m=m_i^*} = \left.\frac{\partial Qj}{\partial m}\right|_{m=m_j^*} = \cdots \sum_i^N m_i^* = \text{Const.} \tag{3}$$

In Eq. (3), "$m_i$*" denotes the number of vehicles, and "Qi", "Qj" denote convex functions each representing a relationship between the number of vehicles and a flow rate of vehicles.

As is obvious from Eq. (3), when partial differential values obtained by partially differentiating the convex function Qi to be obtained from flow rate information of each road 2, by a value near the number $m_i$ of vehicles are equal to each other, the total number of flow rates of vehicles on each road 2 is maximum. Therefore, the number of vehicles at which the partial differential values of each convex function Qi are equal to each other is the target number of vehicles on each road 2.

In view of the above, an initial value of the number m, of vehicles is given, convex functions are respectively partially differentiated by a value near the number $m_i$ of vehicles, and the partial differential values are compared with each other so that the number $m_i$ of vehicles to be allocated is increased or decreased to make a difference between the partial differential values equal to or smaller than a predetermined value. Repeating the aforementioned operation makes it possible to solve a convex programming problem.

In the examples illustrated in FIGS. 10A to 10C, a partial differential value obtained by partially differentiating a convex function 50 by a value near the number 51 of vehicles corresponds to a gradient of a straight line 52 tangential to the convex function 50 at a value near the number 51 of vehicles. Therefore, it is possible to solve a convex programming problem by increasing or decreasing the numbers 51-2, 51-3, and 51-4 of vehicles in such a manner that a difference between the gradients of the straight lines 52-2, 52-3, and 52-4 illustrated in FIG. 10A, FIG. 10B, and FIG. 10C is made small.

Note that an upwardly convex function has characteristics such that as the variable increases, the differential value decreases, and as the variable decreases, the differential value increases. Therefore, when the partial differential value of a convex function is large, the number of vehicles is increased, and when the partial differential value of the convex function is small, the number of vehicles is decreased. This makes it possible to make a difference between partial differential values of each of the convex functions 50-1 to 50-4 small. Repeating the aforementioned operation makes it possible to approximate the number of vehicles to be allocated to each road 2 to a value that maximizes the total number of flow rates of vehicles on each road 2.

Generally, falling of the flow rate of vehicles on the road 2 is a sign that traffic congestion may occur on the road 2. In view of the above, as described in the exemplary embodiment, determining the target number of vehicles with use of a partial differential value of a convex function representing a relationship between the flow rate of vehicles and the number of vehicles, and determining whether the flow rate is to be increased or decreased based on a comparison between the target number of vehicles and the actual number of vehicles makes it possible to adjust the flow rate before falling of the flow rate occurs.

An increment or a decrement in the number of vehicles may be changed depending on a difference between each partial differential value and an average value. Taking into account the characteristics of a convex function, when a difference between a partial differential value and an average value is large, a time required for the actual number of vehicles to reach the target number of vehicles is long, as compared with a case in which the difference is small. Therefore, when a difference between each partial differential value and an average value is large, it is possible to shorten a time required for determining the target number of vehicles by increasing an increment or a decrement in the number of vehicles.

Figure 11:
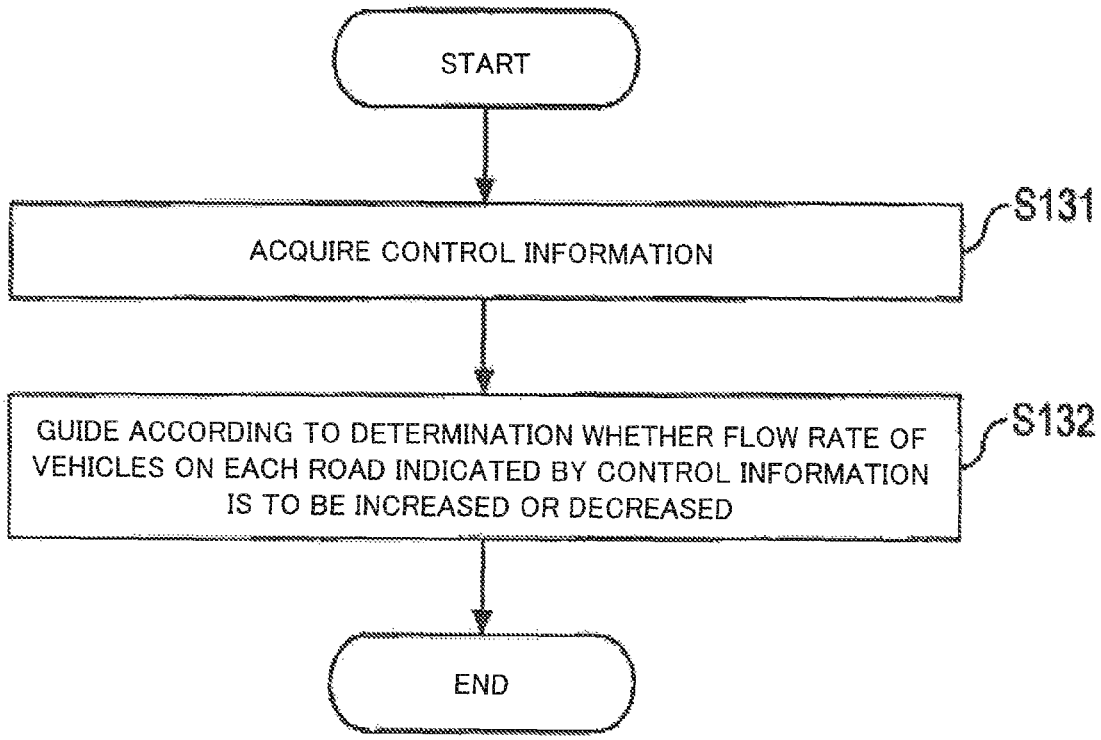
FIG. 11 is a flowchart illustrating an operation of a guidance unit illustrated in FIG. 5.

Next, an operation of the vehicle guidance unit 22 is described referring to the flowchart illustrated in FIG. 11.

The vehicle guidance unit 22 performs the following process in response to receiving control information from the server 30 by the communication unit 21.

As a first step, the vehicle guidance unit 22 acquires control information received by the communication unit 21 (Step S131).

Subsequently, the vehicle guidance unit 22 guides vehicles according to determination whether the vehicles on each road 2 are to be increased or decreased indicated by the acquired control information (Step S132). As described above, a concrete example of the vehicle guidance unit 22 is a display device. In this case, the vehicle guidance unit 22 causes the display device to display an image for guiding the vehicles.

Figure 12:
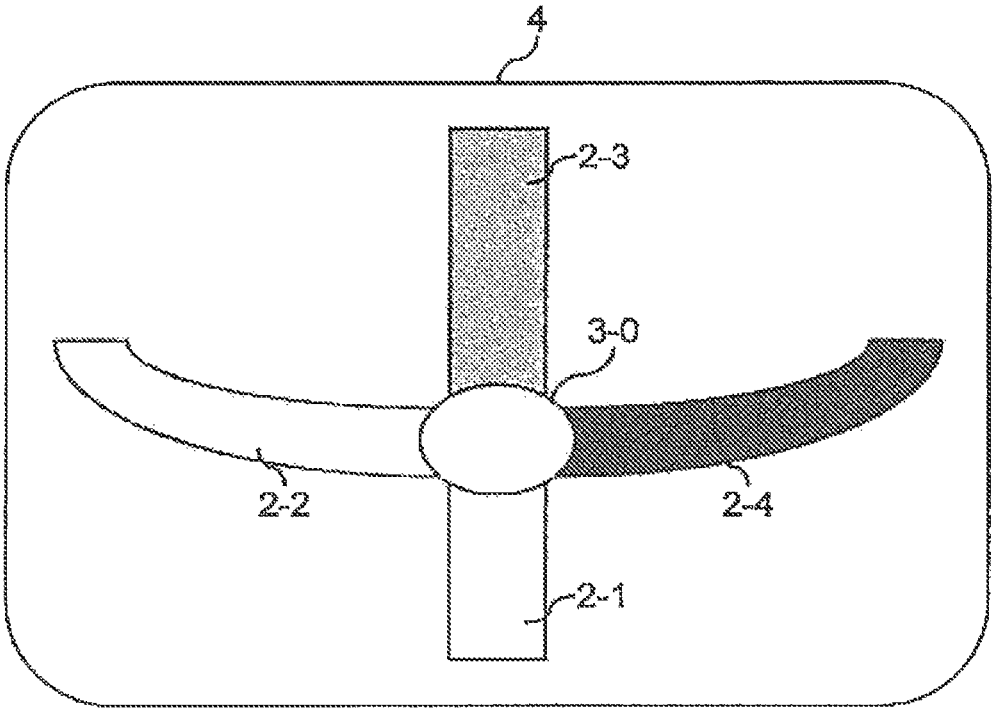
FIG. 12 is a diagram illustrating an example of a vehicle guidance method by the guidance unit illustrated in FIG. 5.

FIG. 12 is a diagram illustrating an example of an image 4 to be displayed by the vehicle guidance unit 22.

In FIG. 12, description is given for an exemplary case in which the vehicle guidance unit 22 of the vehicle guidance device 20 installed at the intersection 3-0 illustrated in FIG. 2 guides vehicles entering the intersection 3-0 from the road 2-1. Further, in FIG. 12, it is assumed that the road 2-4 is more congested than the road 2-3, the road 2-3 is more congested than the road 2-2, and the determination unit 34 determines to decrease the flow rate of vehicles on the roads 2-4 and 2-3. Further, it is assumed that the determination unit 34 determines to greatly decrease the flow rate of vehicles on the road 2-4 further than the flow rate of vehicles on the road 2-3, because the road 2-4 is more congested than the road 2-3.

For example, the vehicle guidance unit 22 causes to display a road whose decrement in the flow rate is large with a dark color. As described above, the determination unit 34 determines to decrease the flow rate of vehicles on the road 2-4 greatly further than the flow rate of vehicles on the road 2-3. In this case, the vehicle guidance unit 22 causes to display the road 2-4 with the darkest color, and then display the road 2-3 with a color lighter than the color of the road 2-4, and with a color darker than the color of the road 2-2.

Changing the display of each road depending on a degree of congestion makes it possible to guide the vehicles entering the intersection 3-0 from the road 2-1 to the road 2-2 whose degree of congestion is low.

As described above, in the vehicle guidance system 1 in the exemplary embodiment, the flow rate detection device 10 is installed on each of the roads 2 included in a road network, detects the flow rate of vehicles on each road 2, and generates flow rate information indicative of the detection result. The server 30 acquires flow rate information of the road 2 from the flow rate detection device 10, and stores the acquired flow rate information and road identification information indicative of the associated road in association with each other. Further, the server 30 specifies, for each of the roads 2 included in a road network, a road which vehicles enter from the road 2 as a candidate road. Further, the server 30 acquires flow rate information stored in association with road identification information indicative of a candidate road, determines whether the flow rate of vehicles on a candidate road is to be increased or decreased based on the acquired flow rate information, and causes the vehicle guidance unit 20 to guide the vehicles according to the determination result.

Increasing or decreasing the flow rate of vehicles on each road 2 based on flow rate information of each road 2 makes it possible to determine whether the flow rate of vehicles on each road 2 is to be increased or decreased so that the total number of flow rates of vehicles on each road 2 is made larger. Guiding the vehicles according to the determination result makes it possible to suppress occurrence of traffic congestion.

The following is some of the modifications of the exemplary embodiment.

For example, the exemplary embodiment describes the exemplary case in which the vehicle guidance device 20 is installed at each intersection 3 to guide vehicles. The exemplary embodiment is not limited to the above. For example, a car navigation device, a smartphone, or a tablet terminal including a display device may be installed in each vehicle, and an image for guiding vehicles may be displayed on the display device of these devices. According to this configuration, there is no need of installing the vehicle guidance device 20. This is advantageous in suppressing the infrastructure installation cost.

Further, when the destination of each vehicle is known by a navigation function or the like, candidate roads may be limited to roads serving as candidates of routes to the destination. This makes it possible to avoid guiding a vehicle to a road largely away from the destination of the vehicle.

Further, a signal installed at the intersection 3 may be controlled to change an entering permission time period during which vehicles are permitted to enter each road. Further, when the road 2 is a toll road, and the vehicle guidance unit 22 has a function of charging the vehicles depending on the road where the vehicles run, it is possible to vary the toll (e.g. make the toll cheaper) depending on a degree of congestion of each road 2 to give an incentive to the drivers driving on the road 2 where the degree of congestion is low.

Further, in the exemplary embodiment, the determination unit 34 determines whether the flow rate of vehicles is to be increased or decreased for each candidate road independently of each other. The exemplary embodiment is not limited to the above. For example, the determination unit 34 may determine whether the flow rate of vehicles on a candidate road is to be increased or decreased, not only with use of flow rate information of the candidate road, but also with use of flow rate information of a road (hereinafter, referred to as a succeeding road) to which the vehicles enter from the candidate road.

Specifically, the determination unit 34 calculates the target number of vehicles on a candidate road, and the target number of vehicles on the succeeding road 2 and determines a smaller number of vehicles, out of the two target numbers of vehicles, as the target number of vehicles on the candidate road.

According to this configuration, it is possible to determine whether the flow rate of vehicles on a candidate road is to be increased or decreased, taking into account a status of the succeeding road that follows the candidate road. Therefore, even when there is a road as a bottleneck (a road where traffic congestion is likely to occur) that follows a candidate road, it is possible to adjust the flow rate of vehicles on each road 2 in such a manner as to suppress occurrence of traffic congestion as much as possible.

Further, the exemplary embodiment describes the exemplary case in which the vehicle guidance system 1 is provided with the flow rate detection devices 10, the vehicle guidance devices 20, and the server 30. The exemplary embodiment is not limited to the above. For example, it is possible to omit the server 30, and to decentralize the function of the server 30 among vehicle guidance devices 20.

Figure 13:
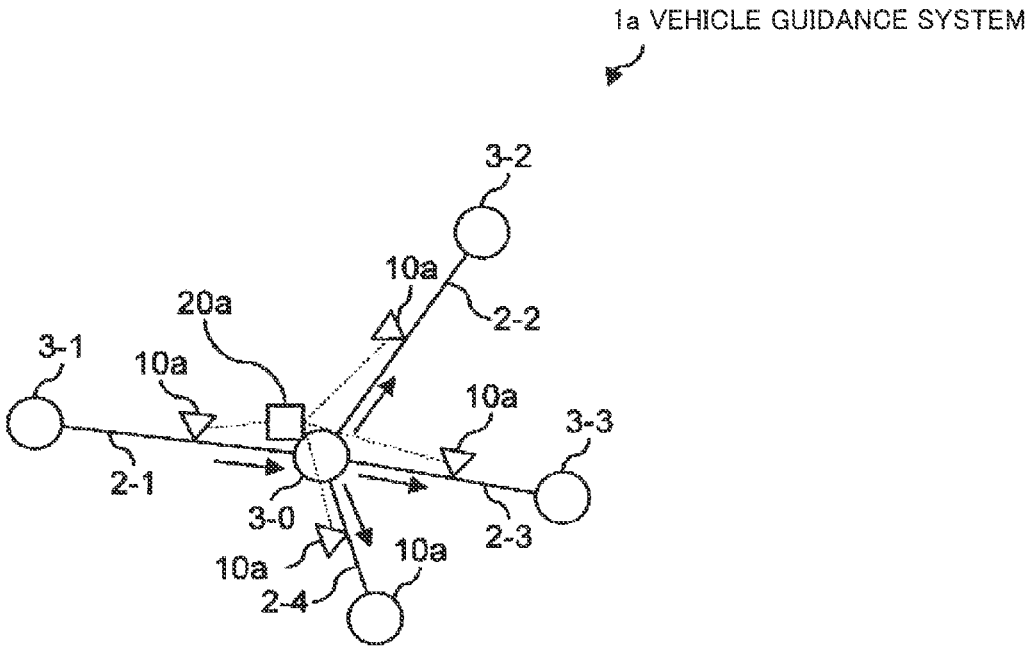
FIG. 13 is a diagram illustrating another configuration of the vehicle guidance system in the first exemplary embodiment of the present invention.

FIG. 13 is a diagram illustrating a configuration of a vehicle guidance system 1*a*, in which the function of the server 30 is decentralized among vehicle guidance devices. The same constituent elements in FIG. 13 as those in FIG. 2 are indicated with the same reference signs, and description thereof is omitted herein.

The vehicle guidance system 1*a* illustrated in FIG. 13 is different from the vehicle guidance system 1 illustrated in FIG. 2 in a point that the server 30 is omitted, a point that the flow rate detection devices 10 are replaced by flow rate detection devices 10*a*, and a point that the vehicle guidance devices 20 are replaced by vehicle guidance devices 20*a*.

The flow rate detection device 10*a* is installed on each of the roads 2 included in a road network. Further, the vehicle guidance device 20*a* is installed at each of intersections 3.

The flow rate detection device 10*a* detects a flow rate of vehicles and speeds of vehicles on the road 2 where the flow rate detection device 10*a* is installed, and transmits flow rate information indicative of the detection result and road identification information to the vehicle guidance device 20*a* installed at the intersection 3 to which the road 2 installed with the flow rate detection device 10*a* is connected.

The vehicle guidance device 20*a* determines whether the flow rate of vehicles is to be increased or decreased on the road 2 connected to the intersection 3 where the vehicle guidance device 20*a* is installed based on the flow rate information transmitted from the flow rate detection device 10*a*, and guides the vehicles according to the determination result.

Next, a configuration of the flow rate detection device 10*a* and a configuration of the vehicle guidance device 20*a* are described.

Figure 14:
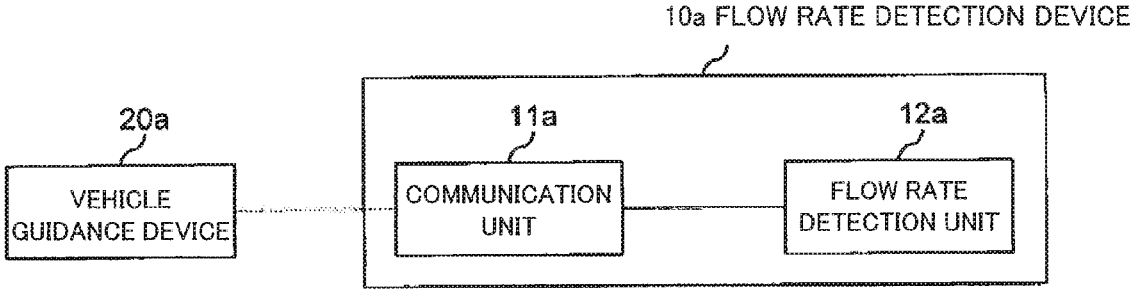
FIG. 14 is a block diagram illustrating a configuration of a flow rate detection device illustrated in FIG. 13.

First of all, the configuration of the flow rate detection device 10*a* is described referring to the block diagram illustrated in FIG. 14.

The flow rate detection device 10*a* illustrated in FIG. 14 is different from the flow rate detection device 10 illustrated in FIG. 3 in a point that the communication unit 11 is replaced by a communication unit 11*a*, and a point that the flow rate detection unit 12 is replaced by a flow rate detection unit 12*a*.

The communication unit 11*a* communicates with the vehicle guidance device 20*a*. Note that the flow rate detection device 10*a* and the vehicle guidance device 20*a* are physically proximate to each other. Therefore, using a short-distance wireless network such as a wireless LAN, an ad hoc network, or DTN (Delay Tolerant Network) makes it possible to communicate between the flow rate detection device 10*a* and the vehicle guidance device 20*a* with an inexpensive configuration. A method for configuring a network using a wireless LAN, an ad hock network, DTN, or the like is well-known to a person skilled in the art, and has no direct relation to the present invention. Therefore, description on this method is omitted.

The flow rate detection unit 12*a* periodically detects a flow rate of vehicles and speeds of vehicles on the road 2 where the flow rate detection device 10 is installed, and generates flow rate information indicative of the detection result. Further, the flow rate detection unit 12*a* causes the communication unit 11*a* to transmit the generated flow rate information and road identification information to the vehicle guidance device 20*a*. The flow rate detection unit 12*a* is an example of a flow rate detection unit.

Figure 15:
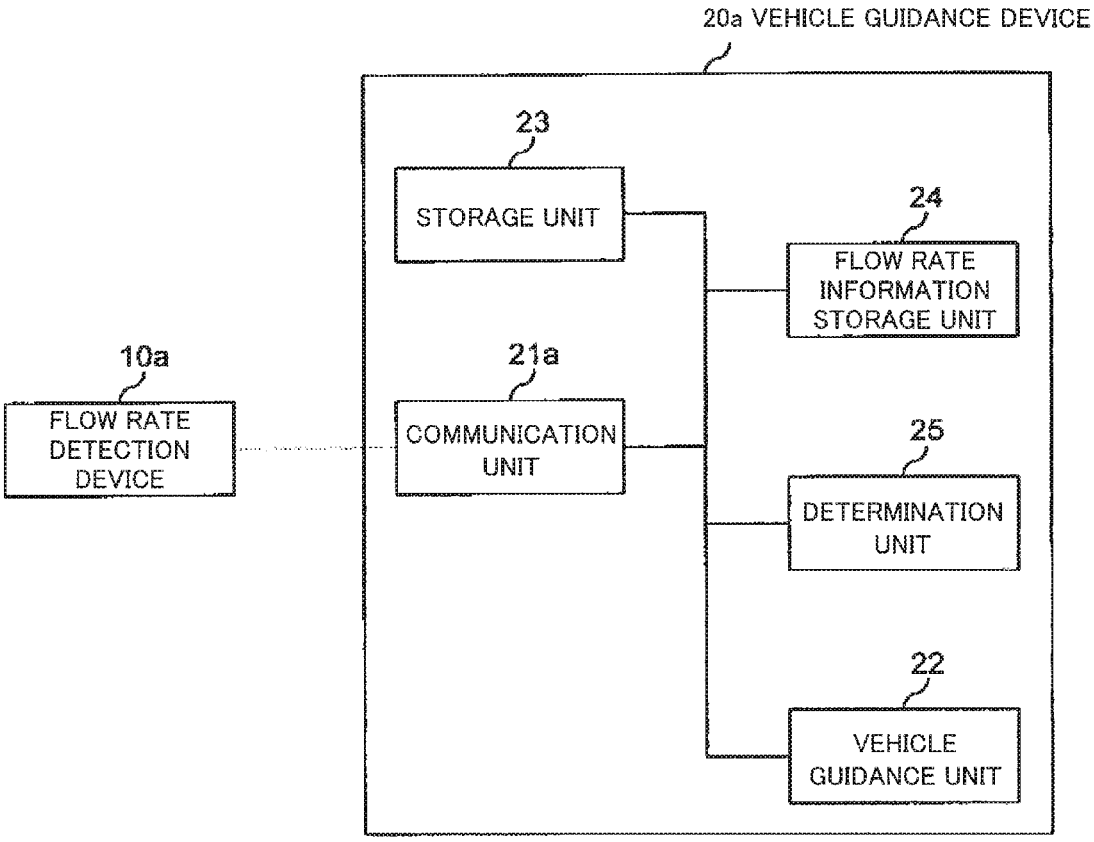
FIG. 15 is a block diagram illustrating a configuration of a vehicle guidance device illustrated in FIG. 13.

Next, the configuration of the vehicle guidance device 20*a* is described referring to the block diagram illustrated in FIG. 15.

The vehicle guidance device 20*a* illustrated in FIG. 15 is different from the vehicle guidance device 20 illustrated in FIG. 4 in a point that the communication unit 21 is replaced by a communication unit 21*a*, and a point that a storage unit 23, a flow rate information storage unit 24, and a determination unit 25 are additionally provided.

The communication unit 21*a* communicates with the flow rate detection device 10*a* (communication unit 11*a*).

The storage unit 23 temporarily or permanently stores various items of information. The storage unit 23 is an example of a storage unit.

When the communication unit 21*a* receives flow rate information and road identification information from the flow rate detection device 10*a*, the flow rate information storage unit 24 causes the storage unit 23 to store the flow rate information and the road identification information in association with each other.

The determination unit 25 selects one of the roads 2 connected to the intersection 3 where the vehicle guidance device 20*a* is installed as a selected road, and specifies a road which vehicles enter from the selected road as a candidate road. Further, the determination unit 25 acquires flow rate information stored in the storage unit 23 in association with road identification information indicative of a candidate road, determines whether the flow rate of vehicles on the candidate road is to be increased or decreased based on the acquired flow rate information, and causes a vehicle guidance unit 22 to guide the vehicles according to the determination result. The determination unit 25 is an example of a determination unit.

As described above, omitting the server 30 and decentralizing the function of the server 30 among the vehicle guidance devices 20*a* makes it possible to simplify the system configuration.

Further, the exemplary embodiment describes the exemplary case in which the target number of vehicles is obtained by solving a convex programming problem. The exemplary embodiment is not limited to the above. For example, when the flow rate of vehicles on a specific road is lowered, and there is a sign of occurrence of traffic congestion, the vehicle guidance system may be operated in such a manner as to avoid congestion of vehicles based on an assumption that stability of the system is lowered.

As a method for performing the aforementioned operation, there is a method in which a Langevin's equation is used. According to this method, a potential term of a Langevin's equation is multiplied by a variable for evaluating stability of a system. The system is operated in such a manner that when the system is stable, the potential term is dominant, and when the system is unstable, the noise term is dominant. In the following, an equation such that a potential term of a Langevin's equation is multiplied by a variable for evaluating stability of the system is called as a fluctuation equation.

An example of the operation when the fluctuation equation is applied to the vehicle guidance system according to the present invention is described.

A potential term in the fluctuation equation corresponds to a distribution based on which vehicles are guided to each road in the vehicle guidance system according to the present invention. When the system is stable, in other words, when there is no traffic congestion, the system is operated in such a manner that the potential tem is dominant. On the other hand, when the system is unstable, in other words, when traffic congestion occurred on a specific road, the system is operated in such a manner that the noise term is dominant. In this case, the distribution based on which vehicles are guided to each road is changed at random until the traffic congestion is eliminated. This makes it possible to operate the vehicle guidance system in such a manner that the traffic congestion is eliminated, even when a cause of traffic congestion is unclear.

Further, the exemplary embodiment describes the exemplary case in which the flow rate detection unit 12 transmits road identification information and detection time information along with flow rate information. The exemplary embodiment is not limited to the above.

For example, the server 30 may be caused to store correlations between the flow rate detection device 10, the road 2 where the flow rate detection device 10 is installed, and the traveling direction of vehicles on the road 2 at the time of installation of the flow rate detection device 10 or the like. In this case, the flow rate detection unit 12 may transmit identification information of the flow rate detection device 10, in place of road identification information.

Further, the flow rate detection unit 12 may cause the communication unit 11 to transmit identification information of the flow rate detection device 10 and road identification information to the server 30 at the time of activation of the flow rate detection device 10 or the like. In this case, as far as identification information of the flow rate detection device 10 and road identification information are stored in the server 30 in association with each other, the flow rate detection unit 12 is allowed to transmit only the identification information of the flow rate detection device 10 without transmitting the road identification information thereafter.

Further, in the exemplary embodiment, the flow rate detection unit 12 transmits road identification information and detection time information along with flow rate information. The flow rate information storage unit 24 causes the storage unit 23 to store the flow rate information, the road identification information, and the detection time information in association with each other, each time these items of information are transmitted.

The present invention, however, is not limited to the above. The flow rate detection unit 12 may transmit flow rate information and road identification information. The flow rate information storage unit 24 may update the flow rate information to be stored in association with the road identification information, each time these items of information are transmitted. Further, the received time at which these items of information are received may be updated accordingly. This is advantageous in reducing the amount of information to be transmitted to the server 30.

<Second Exemplary Embodiment>

A vehicle guidance system in the second exemplary embodiment of the present invention is configured to acquire position information from vehicles traveling on a road 2, and to detect a flow rate of vehicles on the road 2 based on a timewise variation in the position of vehicles indicated by the position information.

Figure 16:
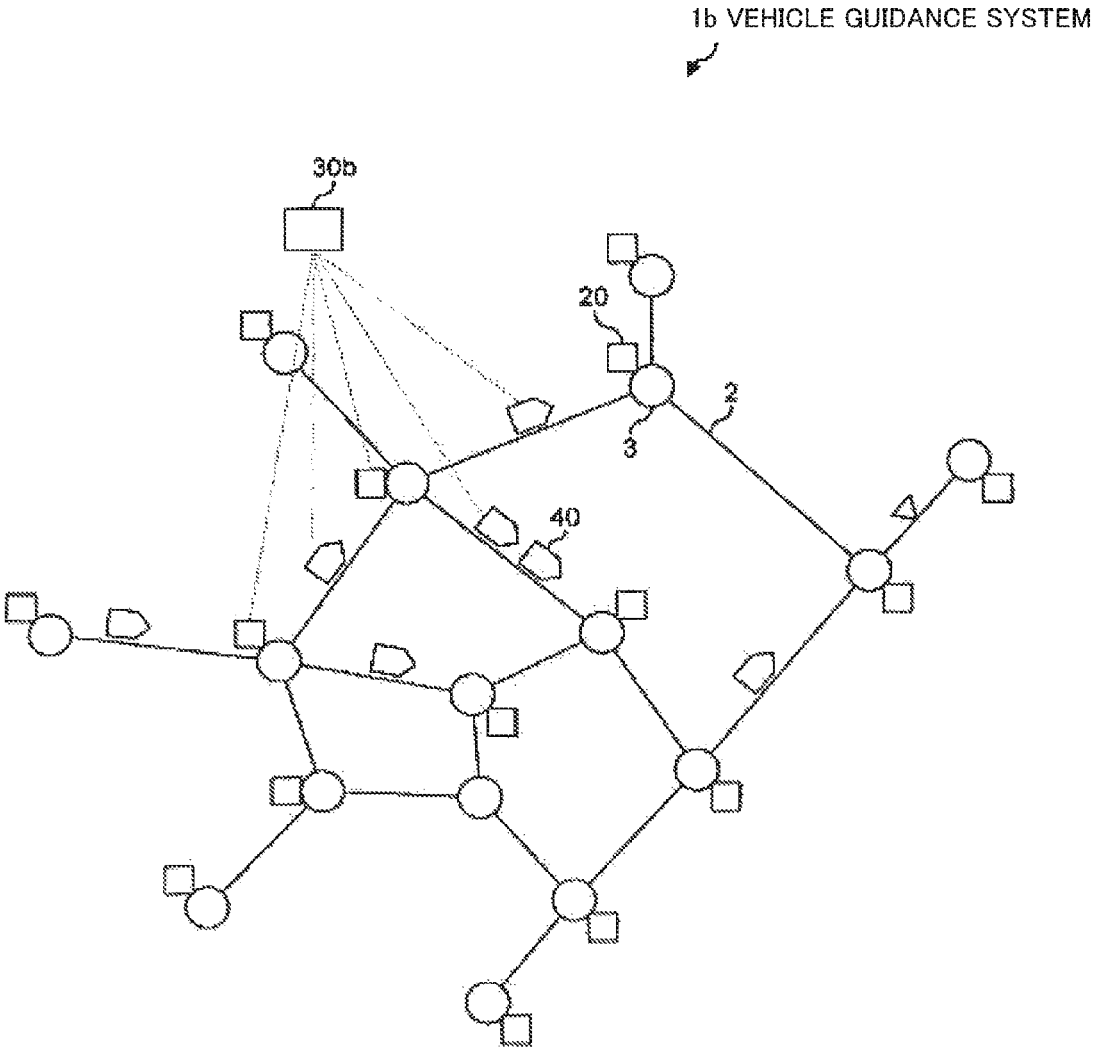
FIG. 16 is a diagram illustrating an overall configuration of a vehicle guidance system in a second exemplary embodiment of the present invention.

FIG. 16 is a diagram illustrating a configuration of a vehicle guidance system 1*b* in the exemplary embodiment. The same constituent elements in FIG. 16 as those in FIG. 1 are indicated with the same reference signs, and description thereof is omitted herein.

The vehicle guidance system 1*b* in the exemplary embodiment is different from the vehicle guidance system 1 in the first exemplary embodiment in a point that the flow rate detection device 10 is omitted, and a point that the server 30 is replaced by a server 30*b*.

The server 30*b* acquires position information from a vehicle 40 traveling on the road 2, and detects a flow rate of vehicles on each of the roads 2 included in a road network based on a timewise variation in the position of the vehicle 40 indicated by the position information. Further, the server 30*b* determines whether the flow rate of vehicles on each road 2 is to be increased or decreased based on flow rate information indicative of the detection result, and causes a vehicle guidance device 20 to guide the vehicles according to the determination result.

Next, a configuration of the vehicle 40 and a configuration of a server 30*b* are described.

Figure 17:
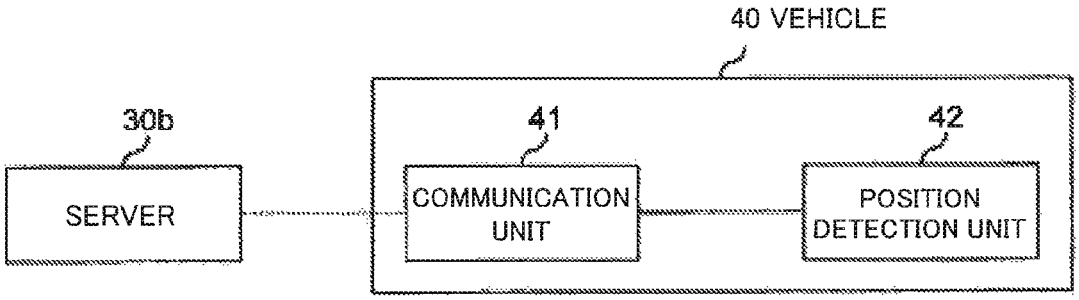
FIG. 17 is a block diagram illustrating a configuration of vehicle-mounted devices illustrated in FIG. 16.

First of all, the configuration of the vehicle 40 is described referring to the block diagram illustrated in FIG. 17.

The vehicle 40 illustrated in FIG. 17 includes a communication unit 41 and a position detection unit 42.

The communication unit 41 communicates with the server 30*b*.

The position detection unit 42 periodically detects the position of the vehicle 40, and causes the communication unit 41 to transmit, to the server 30*b*, position information indicative of the detected position, and position detection time information indicative of a time at which position detection is performed. Note that the position detection unit 42 receives a GPS (Global Positioning System) signal from a GPS satellite, and detects the position of the vehicle 40 using the received GPS signal. The position detection unit 42 is an example of a position detection unit.

Figure 18:
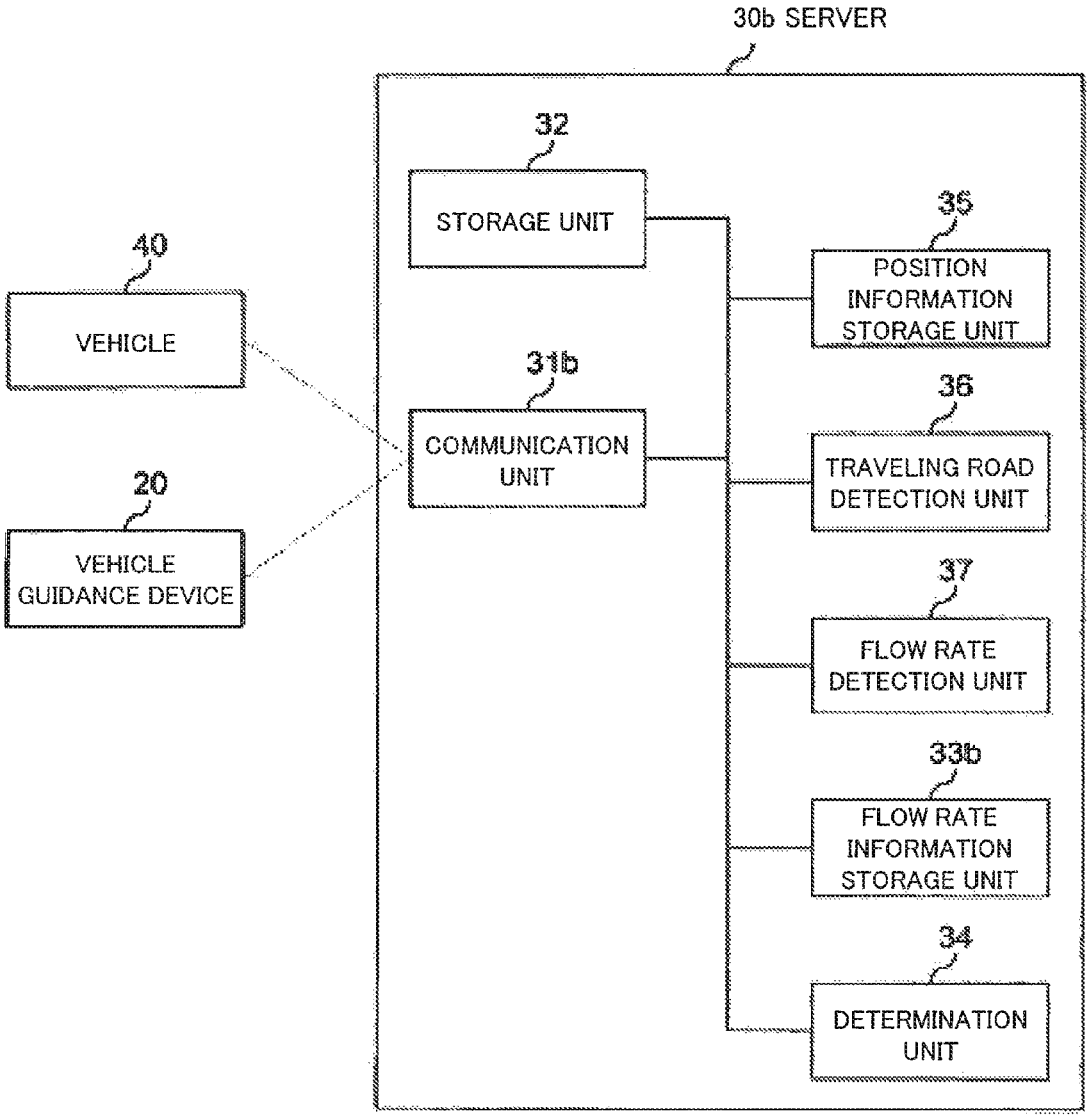
FIG. 18 is a block diagram illustrating a configuration of a server illustrated in FIG. 16.

Next, the configuration of the server 30*b* is described referring to the block diagram illustrated in FIG. 18.

The server 30*b* illustrated in FIG. 18 is different from the server 30 illustrated in FIG. 5 in a point that the communication unit 31 is replaced by a communication unit 31*b*, a point that the flow rate information storage unit 33 is replaced by a flow rate information storage unit 33*b*, and a point that a position information storage unit 35, a traveling road detection unit 36, and a flow rate detection unit 37 are additionally provided. The flow rate detection unit 37 is an example of an acquisition unit.

The communication unit 31*b* communicates with the vehicle guidance device 20 and with the vehicle 40.

When the communication unit 31*b* receives position information transmitted from the vehicle 40 and position detection time information, the position information storage unit 35 causes the storage unit 32 to store the position information and the position detection time information in association with vehicle information indicative of the vehicle 40.

The traveling road detection unit 36 detects the traveling road and the traveling direction of each vehicle 40 based on the position information and the position detection time information of each vehicle 40, which are stored in the storage unit 32.

The flow rate detection unit 37 detects the flow rate of vehicles 40 and the speeds of the vehicles 40 on each road 2 based on the traveling road and the traveling direction of each vehicle 40 detected by the traveling road detection unit 36, and acquires flow rate information indicative of the detection result.

The flow rate information storage unit 33*b* causes the storage unit 32 to store the flow rate information of the road 2 acquired by the flow rate detection unit 37, the detection time information indicative of a time at which the flow rate of the vehicles 40 and the speeds of the vehicles 40 are detected, and road identification information indicative of the road 2 in association with each other.

Next, an operation of the vehicle guidance system 1*b* in the exemplary embodiment is described.

Figure 19:
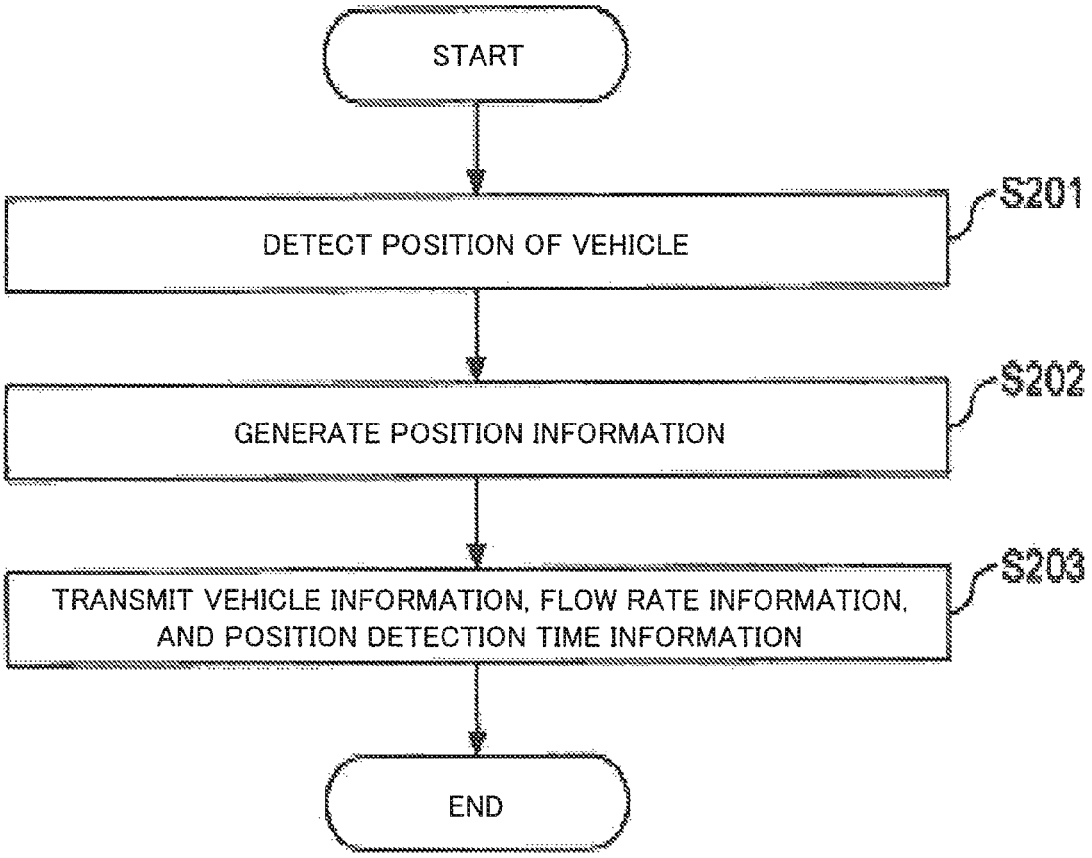
FIG. 19 is a flowchart illustrating an operation of a position detection unit illustrated in FIG. 17.

First of all, an operation of the position detection unit 42 is described referring to the flowchart illustrated in FIG. 19.

As a first step, the position detection unit 42 detects the position of the vehicle installed with the position detection unit 42 with use of a GPS signal or the like (Step S201), and generates position information indicative of the detected position (Step S202).

Subsequently, the position detection unit 42 causes the communication unit 41 to transmit vehicle information indicative of the vehicle 40, and the generated position information and position detection time information to the server 30*b* (Step S203).

The position detection unit 42 periodically performs Step S201 to Step S203 as described above.

Figure 20:
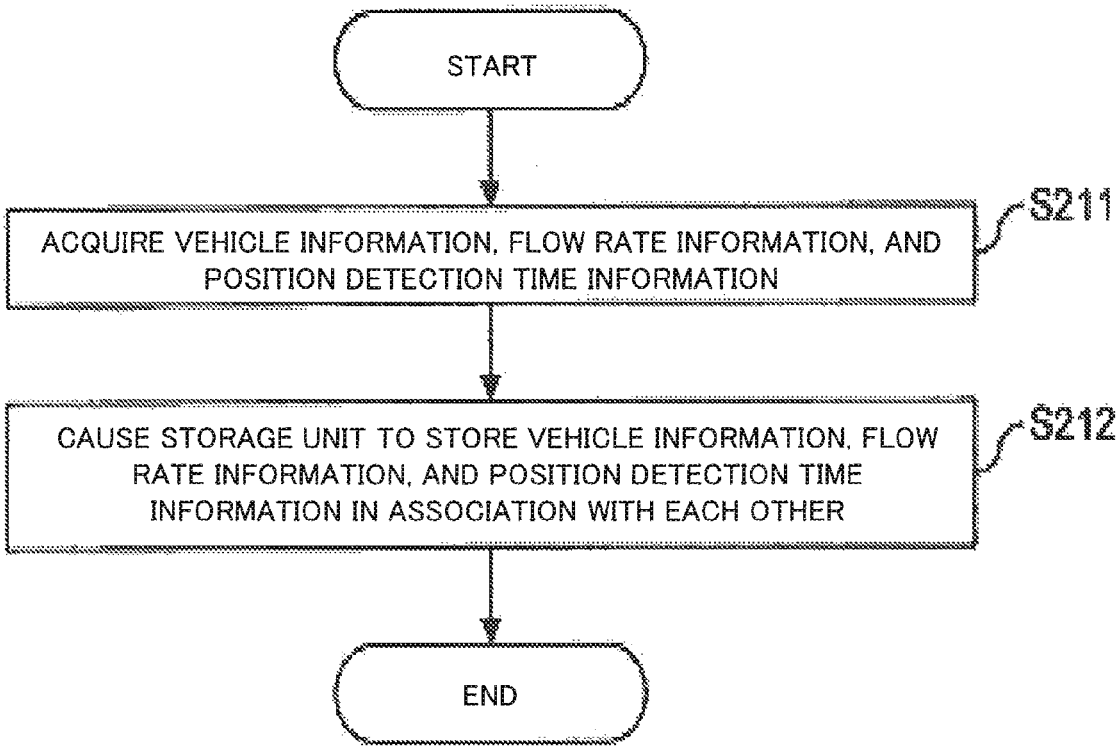
FIG. 20 is a flowchart illustrating an operation of a position information storage unit illustrated in FIG. 18.

Next, an operation of the position information storage unit 35 is described referring to the flowchart illustrated in FIG. 20.

The position information storage unit 35 performs the following process in response to receiving the information from the vehicle 40 by the communication unit 31*b*.

As a first step, the position information storage unit 35 acquires vehicle information, flow rate information, and position detection time information received by the communication unit 31*b* (Step S211).

Subsequently, the position information storage unit 35 causes the storage unit 32 to store the acquired vehicle information, flow rate information, and position detection time information in association with each other (Step S212), and the process is terminated.

Figure 21:
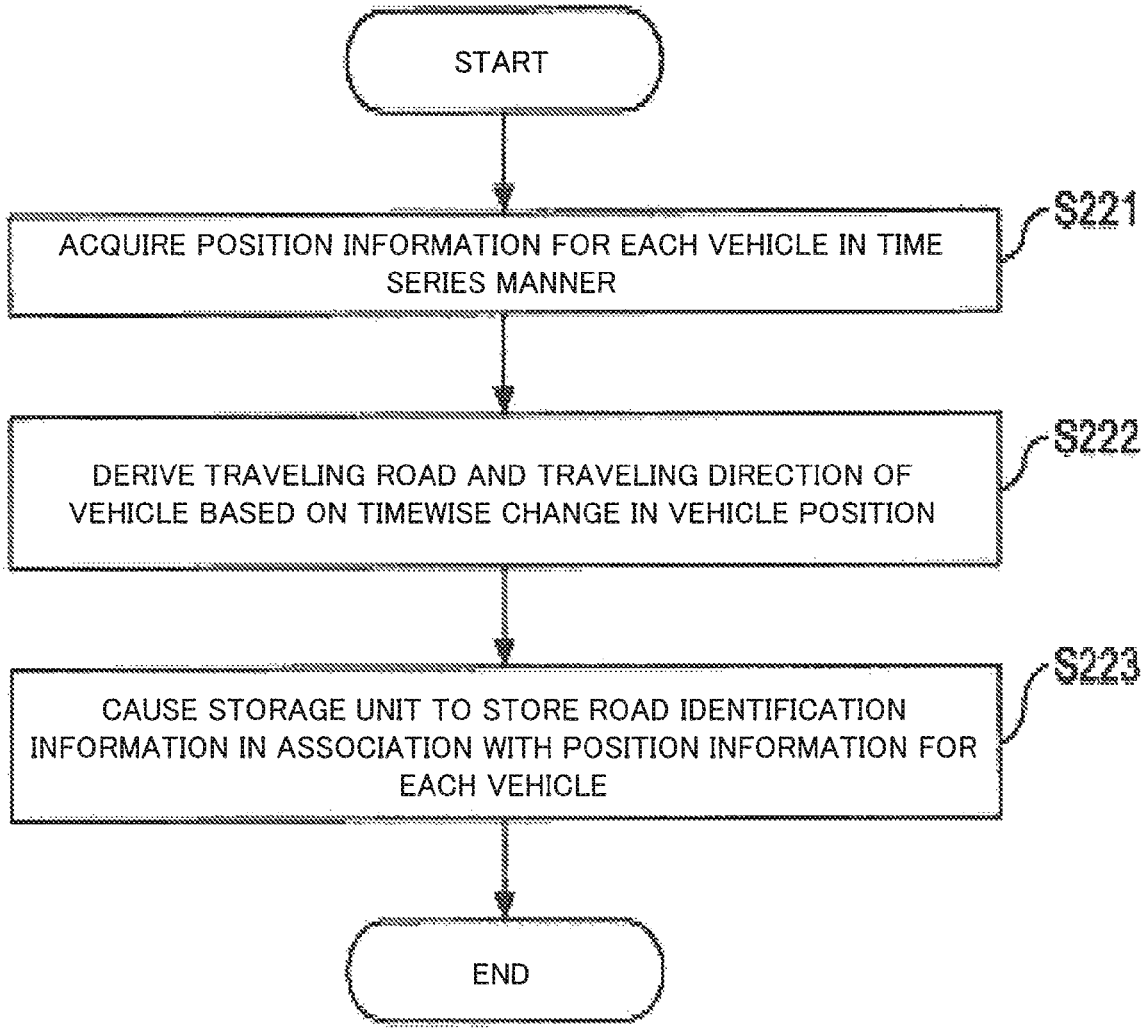
FIG. 21 is a flowchart illustrating an operation of a traveling road detection unit illustrated in FIG. 18.

Next, an operation of the traveling road detection unit 36 is described referring to the flowchart illustrated in FIG. 21.

As a first step, the traveling road detection unit 36 acquires position information of each vehicle 40 from the storage unit 32 in a time series manner (Step S221).

Subsequently, the traveling road detection unit 36 derives the traveling road and the traveling direction of the vehicle 40 based on a timewise change in the position of the vehicle 40 indicated by the position information (Step S222). It is possible to derive the traveling road of the vehicle 40 by using the acquired position information and map information from GIS (Geographic Information System) or the like. Further, it is possible to derive the traveling direction of the vehicle 40 from a timewise change in the position of the vehicle 40 on the traveling road. A method for deriving a traveling road and a traveling direction is well-known to a person skilled in the art. Therefore, detailed description on the method is omitted.

Performing Step S222 makes it possible to specify the traveling road and the traveling direction of each vehicle 40 at each point of time.

Subsequently, the traveling road detection unit 36 causes the storage unit 32 to store road identification information indicative of the traveling road and the traveling direction of the vehicle 40 in association with position information, and position detection time information of the vehicle 40.

The traveling road detection unit 36 periodically performs Step S221 to S223 as described above.

Figure 22:
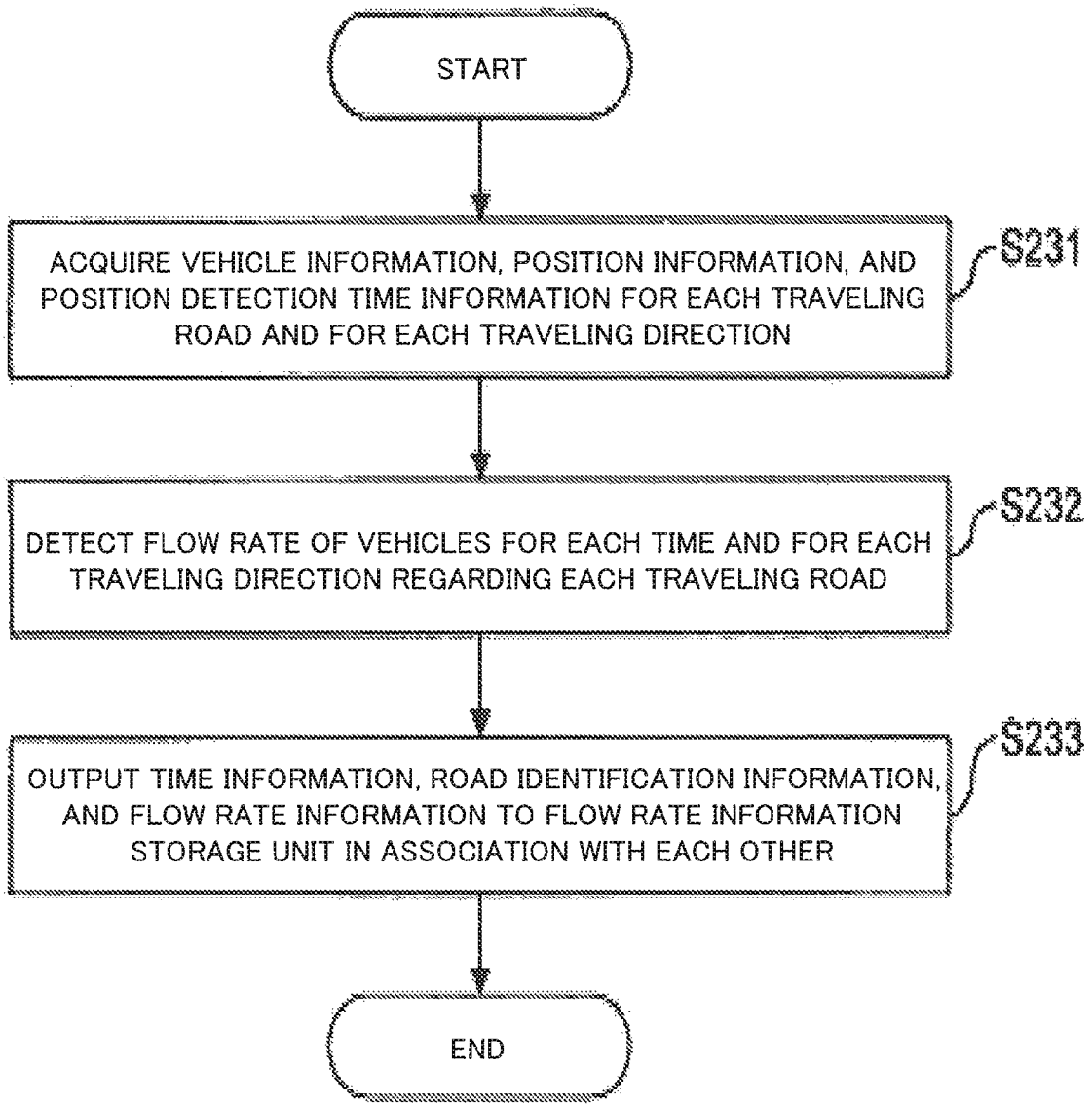
FIG. 22 is a flowchart illustrating an operation of a flow rate detection unit illustrated in FIG. 18.

Next, an operation of the flow rate detection unit 37 is described referring to the flowchart illustrated in FIG. 22.

As a first step, the flow rate detection unit 37 acquires, from the storage unit 32, vehicle information, position information, and position detection time information, for each traveling road and for each traveling direction (Step S231).

Subsequently, the flow rate detection unit 37 detects the flow rate of vehicles for each time and for each traveling direction regarding each traveling road based on the acquired vehicle information, position information, and position detection time information for each traveling road and for each traveling direction.

Subsequently, the flow rate detection unit 37 outputs, to the flow rate information storage unit 33*b*, time information indicative of a detection time, road identification information indicative of a traveling road and a traveling direction, and flow rate information indicative of a flow rate of vehicles on the traveling road in association with each other (Step S233).

The flow rate detection unit 37 periodically performs Step S231 to Step S233 as described above.

Next, an example of the flow rate detection method in the exemplary embodiment is described.

As described above, it is possible to calculate the flow rate of vehicles on the road 2 based on the number of vehicles traveling on the road 2, the speeds of vehicles, and the road capacity of the road 2.

It is possible to calculate the number of vehicles traveling on the road 2 based on the number of vehicles traveling at each point of time. Further, it is possible to calculate the speeds of vehicles using the following Eq. (4).

$$v=\Delta d/\Delta t \qquad \text{Eq. (4)}$$

In Eq. (4), "Δd" denotes a difference in positon of a vehicle, and "Δt" denotes a difference in time at which position information is acquired.

As described above, the road capacity is constant all the time.

Therefore, it is possible to detect the flow rate of vehicles based on position information acquired from the vehicles 40.

As described above, in the vehicle guidance system 1*b* in the exemplary embodiment, the position detection unit 42 installed in the vehicle 40 detects the position of the vehicle 40, and transmits position information indicative of the detected position to the server 30*b*. The server 30*b* detects the flow rate of vehicles on each road 2 based on the position information acquired from the vehicles 40, and determines whether the flow rate of vehicles on each road 2 is to be increased or decreased based on flow rate information indicative of the detected flow rate.

Thus, unlike the first exemplary embodiment, there is no need of installing a flow rate detection device on each road 2. This is advantageous in suppressing the infrastructure installation cost.

In the exemplary embodiment, the speed of the vehicle 40 is calculated based on Eq. (4). The exemplary embodiment is not limited to the above. It is possible to detect the speed of the vehicle 40, and transmit, to the server 30, information indicative of the detected speed in association with vehicle information indicative of the vehicle 40, position information and position detection time information. Examples of the method for detecting the speed of the vehicle 40 are a method in which the vehicle speed is calculated based on a timewise change in the position of the vehicle 40, a method in which an acceleration sensor is installed in the vehicle 40, and the vehicle speed is calculated based on a timewise change in acceleration detected by the acceleration sensor, a method in which the vehicle speed is acquired via a CAN (Controller Access Network), or the like. Directly detecting the speed of the vehicle 40 makes it possible to acquire flow rate information based on higher precision speed information.

Further, the exemplary embodiment describes the exemplary case in which the vehicle guidance device 20*a* installed at the intersection 3 is provided with the vehicle guidance unit 22. The exemplary embodiment is not limited to the above. Each vehicle 40 may be provided with the vehicle guidance unit 22. For example, the function of the vehicle guidance unit 22 may be installed in a navigation device, a smartphone, a tablet terminal, or the like provided in each vehicle 40.

According to the aforementioned configuration, it is possible to suppress the infrastructure installation cost, and to introduce the vehicle guidance system according to the present invention, while suppressing an influence on the existing road infrastructure. For example, it is possible to introduce the vehicle guidance system according to the present invention by providing a device installed with a position detection function or a guiding function in vehicles owned by a delivery company.

The process of each unit may be performed by recording a program for implementing all or a part of the functions of the vehicle guidance system of the present invention in a computer-readable recording medium, and by causing the program recorded in the recording medium to be read by a computer system for execution. Note that the "computer system" in the specification includes an OS (Operation System), or hardware components such as peripheral devices.

Further, the "computer-readable recording medium" is a portable medium such as a magneto-optical disk, a ROM (Read Only Memory), or a non-volatile semiconductor memory; or a storage device such as a hard disk built in a computer system. Further, the "computer-readable recording medium" includes a medium for dynamically holding a program for a short period of time, such as a communication line to be used when a program is transmitted via a network such as the Internet or via a communication line such as a telephone line; and a medium for holding a program for a certain period of time, such as a volatile memory in a computer system serving as a server or a client in the case. Further, the program may be a program for implementing a part of the aforementioned functions, or may be a program which can implement the aforementioned functions by combination with a program already recorded in a computer system.

The invention of the present application has been described as above referring to the exemplary embodiments. The present invention, however, is not limited to the above exemplary embodiments. The configuration and the details of the invention of the present application may be modified in various ways comprehensible to a person skilled in the art in the scope of the invention of the present application.

This application is based upon and claims the benefit of priority from Japanese patent application No. 2013-210848, filed on Oct. 8, 2013, the disclosure of which is incorporated herein in its entirety by reference.

A part or all of the above exemplary embodiments may be described as the following Supplementary Notes, but is not limited to the following.

(Supplementary Note 1)

In a vehicle guidance system that guides vehicles traveling on roads included in a road network, the vehicle guidance system includes:

a flow rate detection unit that detects a flow rate of vehicles on each of the roads included in the road network, and generating flow rate information representing a detection result;

a storage unit that stores the flow rate information of each of the roads generated by the flow rate detection unit in association with road identification information that identifies a road corresponding to the flow rate information;

a determination unit that specifies, as a candidate road, a road which vehicles enter from each of the roads included in the road network, acquires the flow rate information stored in the storage unit in association with the road identification information of the candidate road specified, and determines a rule regarding changing of the flow rate of vehicles on the candidate road based on the flow rate information acquired; and a guidance unit that guides vehicles according to a determination result by the determination unit.

(Supplementary Note 2)

In the vehicle guidance system according to Supplementary Note 1, the guidance unit guides a larger number of vehicles to the candidate road on which the determination unit determined that the flow rate of vehicles is to be increased than to the candidate road on which the determination unit determined that the flow rate of vehicles is to be decreased, out of the candidate roads specified.

(Supplementary Note 3)

In the vehicle guidance system according to Supplementary Note 1 or 2, the vehicle guidance system further includes:

a flow rate detection device that is installed on the road included in the road network and includes the flow rate detection unit;

a vehicle guidance device that is installed at each of intersections where a plurality of the roads are connected to each other and includes the guidance unit; and a management device that is communicable with the flow rate detection device and the vehicle guidance device and includes the storage unit and the determination unit.

(Supplementary Note 4)

In the vehicle guidance system according to Supplementary Note 1 or 2, the vehicle guidance system further includes:

a flow rate detection device that installs on the road included in the road network and includes the flow rate detection unit; and a vehicle guidance device that is communicable with the flow rate detection device, installs at each of intersections where a plurality of the roads are connected to each other, and includes the storage unit, the determination unit and the guidance unit, further, the determination unit specifies the candidate road which vehicles enter from each of roads connected to the intersection where the vehicle guidance device is installed.

(Supplementary Note 5)

In the vehicle guidance system according to Supplementary Note 1 or 2, the vehicle guidance system further includes:

position detection unit mounted on a vehicle for periodically detecting a position of the vehicle and generating position information representing a detected position;

a vehicle guidance device that is installed at each of intersections where a plurality of the roads are connected to each other, and includes the guidance unit; and a management device that is communicable with the vehicle and the vehicle guidance device, and includes the flow rate detection unit, the storage unit, and the determination unit, further, the flow rate detection unit acquires the position information generated by the position detection unit, and detects the flow rate of vehicles on each of the roads based on the position information acquired.

(Supplementary Note 6)

In the vehicle guidance system according to any one of Supplementary Notes 1 to 5, the guidance unit causes display unit installed at an intersection to display for guiding the vehicles.

(Supplementary Note 7)

In the vehicle guidance system according to any one of Supplementary Notes 1 to 5, the guidance unit causes display unit provided in the vehicle to display for guiding the vehicles.

(Supplementary Note 8)

In the vehicle guidance system according to any one of Supplementary Notes 2 to 5, the guidance unit controls a time period during which vehicles are permitted to enter the candidate road by a signal installed at the intersection according to determination whether the flow rate of vehicles on the candidate road determined by the determination unit is to be increased or decreased.

(Supplementary Note 9)

In the vehicle guidance system according to any one of Supplementary Notes 2 to 4, the flow rate detection unit detects the number of vehicles passing through a specific point on a road where the flow rate detection device is installed within a predetermined time period, and detects the flow rate of vehicles on the road based on the detected number of vehicles.

(Supplementary Note 10)

In the vehicle guidance system according to Supplementary Note 5, the flow rate detection unit detects the number of vehicles concurrently traveling on the road based on the position information, and detects the flow rate of vehicles on the road based on the detected number of vehicles.

(Supplementary Note 11)

In the vehicle guidance system according to Supplementary Note 9 or 10, the determination unit determines the target number of vehicles on the candidate road, and determines whether the flow rate of vehicles on the candidate road is to be increased or decreased based on a comparison between the determined target number of vehicles and the number of vehicles detected by the flow rate detection unit.

(Supplementary Note 12)

In the vehicle guidance system according to Supplementary Note 11, the determination unit calculates a partial differential value obtained by partially differentiating a convex function representing a relationship between the flow rate of vehicles obtained from the flow rate information of the candidate road, and the number of vehicles, by the number of vehicles, for each of the candidate roads, and determines the number of vehicles at which the difference between the calculated partial differential values is equal to or smaller than a predetermined value, as the target number of vehicles for each of the candidate roads.

(Supplementary Note 13)

In the vehicle guidance system according to Supplementary Note 11 or 12, the determination unit obtains the target number of vehicles on the candidate road, and the target number of vehicles on a road which vehicles enter from the candidate road, and determines a smaller number of vehicles, out of the target number of vehicles on the candidate road, and the target number of vehicles on the road which vehicles enter from the candidate road, as the target number of vehicles on the candidate road.

(Supplementary Note 14)

In a vehicle guidance method for guiding vehicles traveling on roads included in a road network in a vehicle guidance system, the vehicle guidance method includes:

detecting a flow rate of vehicles on each of the roads included in the road network, and generating flow rate information representing a detection result;

storing the flow rate information of each of the roads in association with road identification information that identifies a road corresponding to the flow rate information;

specifying, as a candidate road, a road which vehicles enter from each of the roads included in the road network, acquiring the flow rate information stored in association with the road identification information of the candidate road specified, and determining a rule regarding changing of the flow rate of vehicles on the candidate road based on the flow rate information acquired; and guiding vehicles according to a determination result.

(Supplementary Note 15)

In the vehicle guidance method according to Supplementary Note 14, the method includes guiding a larger number of vehicles to the candidate road determined that the flow rate of vehicles is to be increased than to the candidate road determined that the flow rate of vehicles is to be decreased, out of the candidate roads specified.

(Supplementary Note 16)

A management device includes:

an acquisition unit that acquires flow rate information representing a detection result on a flow rate of vehicles on each of roads included in a road network;

a storage unit that stores the flow rate information of each of the roads acquired by the acquisition unit in association with road identification information that identifies a road corresponding to the flow rate information; and a determination unit that specifies, as a candidate road, a road which vehicles enter from each of the roads included in the road network, acquires the flow rate information stored in the storage unit in association with the road identification information of the candidate road specified, determining a rule regarding changing of the flow rate of vehicles on the candidate road based on the flow rate information acquired and causing guidance unit for guiding vehicles to guide the vehicles according to the determination result.

(Supplementary Note 17)

In the management device according to Supplementary Note 16, the determination unit determines the target number of vehicles on the candidate road, and determines whether the flow rate of vehicles on the candidate road is to be increased or decreased based on a comparison between the determined target number of vehicles and the number of vehicles detected by the flow rate detection unit.

(Supplementary Note 18)

In the management device according to Supplementary Note 17, the determination unit calculates a partial differential value obtained by partially differentiating a convex function representing a relationship between the flow rate of vehicles obtained from the flow rate information of the candidate road, and the number of vehicles, by the number of vehicles, for each of the candidate roads, and determines the number of vehicles at which the difference between the calculated partial differential values is equal to or smaller than a predetermined value, as the target number of vehicles for each of the candidate roads.

(Supplementary Note 19)

In the management device according to Supplementary Note 17 or 18, the determination unit obtains the target number of vehicles on the candidate road, and the target number of vehicles on a road which vehicles enter from the candidate road, and determines a smaller number of vehicles, out of the target number of vehicles on the candidate road, and the target number of vehicles on the road which vehicles enter from the candidate road, as the target number of vehicles on the candidate road.

(Supplementary Note 20)

In a method for controlling a management device which manages guiding of vehicles traveling on each of roads included in a road network, the method includes:

acquiring flow rate information representing a detection result on a flow rate of vehicles on each of the roads included in the road network;

storing the flow rate information of each road in association with road identification information that identifies a road corresponding to the flow rate information; and specifying, as a candidate road, a road which vehicles enter from each of the roads included in the road network, acquiring the stored flow rate information in association with the road identification information of the candidate road specified, determining a rule regarding changing of a flow rate of vehicles on the candidate road based on the flow rate information acquired and causing guidance unit to guide vehicles to guide the vehicles according to the determination result.

What is claimed is:

1. A vehicle guidance system that guides vehicles traveling on roads included in a road network, the vehicle guidance system comprising:

a flow rate detection unit that detects a flow rate of vehicles on each of the roads included in the road network, and generating flow rate information representing a detection result;

a storage unit that stores the flow rate information of each of the roads generated by the flow rate detection unit in association with road identification information that identifies a road corresponding to the flow rate information;

a determination unit that specifies, as a candidate road, a road which vehicles enter from each of the roads included in the road network, acquires the flow rate information stored in the storage unit in association with the road identification information of the candidate road specified, and determines a rule regarding changing of the flow rate of vehicles on the candidate road based on the flow rate information acquired; and a guidance unit that guides vehicles according to a determination result by the determination unit.

2. The vehicle guidance system according to claim 1, wherein the guidance unit guides a larger number of vehicles to the candidate road on which the determination unit determined that the flow rate of vehicles is to be increased than to the candidate road on which the determination unit determined that the flow rate of vehicles is to be decreased, out of the candidate roads specified.

3. The vehicle guidance system according to claim 1, further comprising:

a flow rate detection device that is installed on the road included in the road network and includes the flow rate detection unit;

a vehicle guidance device that is installed at each of intersections where a plurality of the roads are connected to each other and includes the guidance unit; and a management device that is communicable with the flow rate detection device and the vehicle guidance device and includes the storage unit and the determination unit.

4. The vehicle guidance system according to claim 1, further comprising:

a flow rate detection device that installs on the road included in the road network and includes the flow rate detection unit; and a vehicle guidance device that is communicable with the flow rate detection device, installs at each of intersections where a plurality of the roads are connected to each other, and includes the storage unit, the determination unit and the guidance unit, wherein the determination unit specifies the candidate road which vehicles enter from each of roads connected to the intersection where the vehicle guidance device is installed.

5. The vehicle guidance system according to claim 1, further comprising:

a position detection unit mounted on a vehicle for periodically detecting a position of the vehicle and generating position information representing a detected position;

a vehicle guidance device that is installed at each of intersections where a plurality of the roads are connected to each other, and includes the guidance unit; and a management device that is communicable with the vehicle and the vehicle guidance device, and includes the flow rate detection unit, the storage unit, and the determination unit, wherein the flow rate detection unit acquires the position information generated by the position detection unit, and detects the flow rate of vehicles on each of the roads based on the position information acquired.

6. The vehicle guidance system according to claim 1, wherein the guidance unit causes a display device installed at an intersection to display for guiding the vehicles.

7. The vehicle guidance system according to claim 1 wherein the guidance unit causes a display device provided in the vehicle to display for guiding the vehicles.

8. A vehicle guidance method for guiding vehicles traveling on roads included in a road network in a vehicle guidance system, the vehicle guidance method comprising:

detecting a flow rate of vehicles on each of the roads included in the road network, and generating flow rate information representing a detection result;

storing the flow rate information of each of the roads in association with road identification information that identifies a road corresponding to the flow rate information;

specifying, as a candidate road, a road which vehicles enter from each of the roads included in the road network, acquiring the flow rate information stored in association with the road identification information of the candidate road specified, and determining a rule regarding changing of the flow rate of vehicles on the candidate road based on the flow rate information acquired; and guiding vehicles according to a determination result.

9. A management device comprising:

An acquisition unit that acquires flow rate information representing a detection result on a flow rate of vehicles on each of roads included in a road network;

a storage unit that stores the flow rate information of each of the roads acquired by the acquisition unit in association with road identification information that identifies a road corresponding to the flow rate information; and a determination unit that specifies, as a candidate road, a road which vehicles enter from each of the roads included in the road network, acquires the flow rate information stored in the storage unit in association with the road identification information of the candidate road specified, determining a rule regarding changing of the flow rate of vehicles on the candidate road based on the flow rate information acquired and causing guidance unit that guides vehicles to guide the vehicles according to the determination result.

10. A method for controlling a management device which manages guiding of vehicles traveling on each of roads included in a road network, the method comprising:

acquiring flow rate information representing a detection result on a flow rate of vehicles on each of the roads included in the road network;

storing the flow rate information of each road in association with road identification information that identifies a road corresponding to the flow rate information; and specifying, as a candidate road, a road which vehicles enter from each of the roads included in the road network, acquiring the stored flow rate information in association with the road identification information of the candidate road specified, determining a rule regarding changing of a flow rate of vehicles on the candidate road based on the flow rate information acquired and causing guidance unit that guides vehicles to guide the vehicles according to the determination result.

* * * * *